US005946947A

United States Patent [19]

Lee et al.

[11] Patent Number: 5,946,947

[45] Date of Patent: Sep. 7, 1999

[54] CLOTHES WASHING MACHINE HAVING VIBRATION AND NOISE DAMPER

[75] Inventors: Joon Yeop Lee, Seoul; Sung Jae Shin, Suwon; Jae Cheon Lee, Kyungki-do; Yong Byeong Jeon, Suwon, all of Rep. of Korea

[73] Assignee: Samsung Electronics Co., Ltd., Suwon, Rep. of Korea

[21] Appl. No.: 08/856,086

[22] Filed: May 14, 1997

[30] Foreign Application Priority Data

| | | | |
|---|---|---|---|
| May 30, 1996 | [KR] | Rep. of Korea | 96-13940 |
| May 21, 1996 | [KR] | Rep. of Korea | 96-12817 |
| May 23, 1996 | [KR] | Rep. of Korea | 96-13135 |
| May 23, 1996 | [KR] | Rep. of Korea | 96-13138 |
| May 25, 1996 | [KR] | Rep. of Korea | 96-13178 |
| May 28, 1996 | [KR] | Rep. of Korea | 96-13459 |
| May 29, 1996 | [KR] | Rep. of Korea | 96-13683 |
| May 29, 1996 | [KR] | Rep. of Korea | 96-13717 |
| May 29, 1996 | [KR] | Rep. of Korea | 96-13719 |
| Oct. 1, 1996 | [KR] | Rep. of Korea | 96-32523 |

[51] Int. Cl.[6] ..... D06F 37/24

[52] U.S. Cl. ..... 68/23.3; 68/23.1

[58] Field of Search ..... 68/23.1, 23.2, 68/23.3, 12.06; 248/610, 636

[56] References Cited

U.S. PATENT DOCUMENTS

| | | | |
|---|---|---|---|
| 2,922,891 | 12/1960 | Sundstrom, Jr. | 68/23.2 |
| 3,026,700 | 3/1962 | Bochan et al. | 68/23.3 |
| 3,132,098 | 5/1964 | Bochan | 68/23.3 |
| 3,247,689 | 4/1966 | Waseman | 68/23.3 |
| 3,922,892 | 12/1975 | Bochan | 68/23.3 |
| 3,952,557 | 4/1976 | Bochan | 68/23.3 |
| 4,403,484 | 9/1983 | Fey et al. | 68/23.3 |
| 5,269,159 | 12/1993 | Oh . | |

*Primary Examiner*—Frankie L. Stinson

*Attorney, Agent, or Firm*—Burns, Doane, Swecker & Mathis, L.L.P.

[57] ABSTRACT

A clothes washing machine has an external casing, a tub suspended in the external casing, and a spin basket rotatably installed in the tub and accommodating laundry. A damper includes a first member installed at the lower end of the tub which can wobble together with the tub, and a second member for attenuating vibration transferred to the tub by a mutual action with respect to the first member. Nonlinear and irregular vibration transferred to the tub during a rotational movement of the spin basket can be effectively attenuated, to reduce noise of the washing machine and perform a more stable washing cycle operation.

12 Claims, 22 Drawing Sheets

CLOTHES WASHING MACHINE HAVING VIBRATION AND NOISE DAMPER

BACKGROUND OF THE INVENTION

The present invention relates to a washing machine, and more particularly, to a washing machine having a damper which can attenuate vibration and noise induced during an initial operation of a washing cycle or a dehydrating cycle due to unbalanced laundry contained in a spin basket.

A washing machine 1 includes an external casing 2 for constituting an external appearance, as shown in FIG. 24. A tub 3 containing water for washing and a spin basket 4 which is rotatably installed in the tub are provided in the external casing. The tub 3 is supported by suspended strings 6 movably in the external casing. A pulsator 5 for forming a rotating water current flow for washing, is provided at the bottom of the spin basket 4. A driving motor 7 and a shaft assembly 8 are installed at the lower end of the tub 3, and selectively rotate the spin basket 4 or the pulsator 5 in a predetermined direction according to a program of a controller (not shown) to perform washing and dehydrating cycles.

Meanwhile, during the washing cycles, vibration of the tub 3 occurs due to the rotation of the spin basket 4. The vibration of the tub 3 severely occurs during the dehydrating cycle in which the rotational speed of the spin basket 4 increases. In this case, the size of the vibration is determined according to weight of the laundry and the degree of the unbalance thereof contained in the spin basket. That is, if the weight of the laundry contained in the spin basket lays disproportionate to one side, the spin basket 4 inclines at a corresponding side. As a result, the spin basket 4 collides with the tub 3 during rotation to induce vibration due to mutual contact. Thus, an efficient washing operation of the laundry is prevented by the inclined rotation of the spin basket 4, and generates noise due to excessive vibration.

Thus, to solve such a vibration problem, a conventional washing machine 1 includes the suspension support 6 as shown in FIG. 24. The suspension support 6 includes a suspension bar and a friction buffer 6' which is provided at an end of the suspension bar and fixed to the tub 3. The friction buffer 6' includes a friction cover shaped in the form of a bell, and a friction member and a resilient spring which are provided in the friction cover, to thereby attenuate constantvibration transferred to the tub 3, that is, up-and-down linear vibration.

However, when laundry of more than a prescribed capacity is contained in the tub, the suspension support 6 cannot properly perform vibration attenuation, since the suspension support 6 is mounted initially according to the location of the center of weight in a no-load state of the tub. The suspension support 6 attenuates only up-and-down vibration. Thus, if the spin basket 4 rotates in a disproportionate way in a left-and-right direction due to the disproportionate laundry, such left-and-right vibration is transferred to the tub 3. Accordingly, the left-and-right vibration transferred to the tub 3 induces a wobble of the tub 3 which is suspension-supported in the external casing to thereby prevent a washing machine from operating smoothly. When the wobble thereof is severe, excessive noise is generated due to frictional contact with the external casing 2.

Thus, a washing machine having a system for attenuating the irregular and nonlinear vibration of the spin basket 4 has been recently proposed. U.S. Pat. No. 5,269,159 discloses an example of a washing machine having such a system. In such a washing machine, a sensor is provided for detecting a distance between the tub 3 and the external casing 2, and electromagnets are mounted on mutually opposing outer surfaces. Thus, if the distance between the tub 3 and the external casing 2 which is detected via the sensor is closer than a reference distance, a mutual repelling force is induced between the opposing electromagnets while a mutual attraction force is induced therebetween in a contrary situation, to accordingly maintain a constant distance between the tub 3 and the external casing 2.

However, the above-described conventional washing machine includes a complicated circuit structure to cause cost to be high. Also, it may not be very efficient to attenuate the vibration of the spin basket 4 via the circuit structure. Also, even in the washing machine having a damper which has been proposed in a different form, the structure is complicated and the left-and-right vibration of the tub 3 generated according to the rotational movement of the spin basket 4 cannot be efficiently attenuated.

SUMMARY OF THE INVENTION

To solve the above problems, it is an object of the present invention to provide a washing machine having a damper capable of effectively attenuating nonlinear and irregular vibration of a tub which wobbles in up-and-down and left-and-right directions due to rotational movement of a spin basket.

To accomplish the above object of the present invention, there is provided a washing machine having an external casing, a tub which is suspension-supported in the external casing, and a spin basket rotatably installed in the tub for containing laundry therein, the washing machine comprising: a first member which is installed at the lower end of the tub and can wobble together with the tub; and a second member for attenuating vibration transferred to the tube by a mutual action with respect to the first member.

Here, the first member and the second member can be constructed to frictionally contact each other during wobble of the tub, in which a frictional material is interposed between mutual contact surfaces of the first member and the second member to thereby attenuate vibration transferred to the tub more effectively. The first member and the second member may have a planar frictional contact surface or a curved-shaped frictional contact surface, respectively.

Meanwhile, it is preferable that the washing machine further comprises a relative movement permitting means for enabling the first member to move relatively along the axial direction of the tub with respect to the tub. In this case, the above relative movement means can be simply constructed as a spring member for elastically urging the first member toward the second member and which is interposed between the first member and the tub. Also, the above relative movement means can be simply constructed as a spring member which is installed between the first member and the bottom surface of the external casing.

Here, a through-hole is formed in the center area of the first member in the axial direction of the tub. When the relative movement means is constructed as an action bar fixed to the tub, in such a manner that it is accommodated in the through-hole of the first member so as to be raised, a damping unit can be provided to effectively attenuate vibration to be transferred to the tub in simple structure.

Also, the relative movement permitting means can be simply constructed as a telescopic bar whose one end is fixed to the tub and other end is fixed to the first member, to be extendable and contractible along the axial direction of the tub.

Meanwhile, it is preferable that the washing machine further comprises a relative movement permitting means for enabling the second member to move relatively along the axial direction of the tub with respect to the bottom surface of the external casing. In this case, the above relative movement permitting means can be simply constructed using, a spring member for elastically urging the second member toward the first member and which is interposed between the second member and the bottom surface of the external casing.

Also, the washing, machine further comprises a third member which is disposed to oppose the second member so that the first member will frictionally contact the first member. In this case, it is preferable that the washing machine further comprises an elastically pressing means for elastically pressing the second and third members with respect to the first member.

Meanwhile, the first member extends along the axial direction of the tub in the form of a bar. The second member has an accommodation hole for accommodating the first member with clearance. A modified damping unit can be provided so that an elastic attenuation member which contacts the first member to be elastically deformed is attached to the inner surface of the accommodation hole.

DETAILED DESCRIPTION OF PREFERRED EMBODIMENTS OF THE INVENTION

Preferred embodiments of the present invention will be described with reference to the accompanying drawings.

Figure 1:
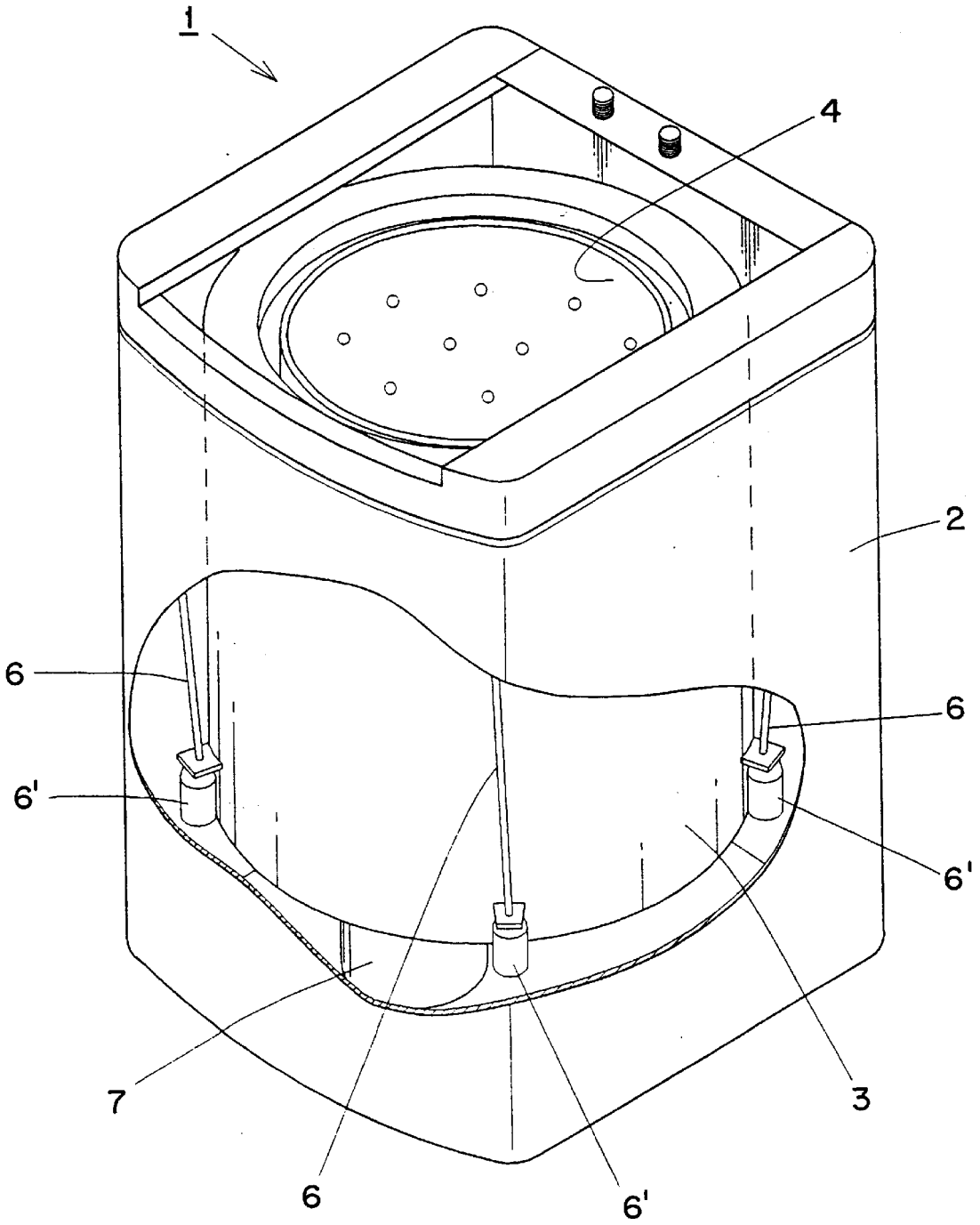
FIG. 1 is a partially cutaway perspective view of a washing machine having a damper according to a first embodiment of the present invention.
Figure 2:
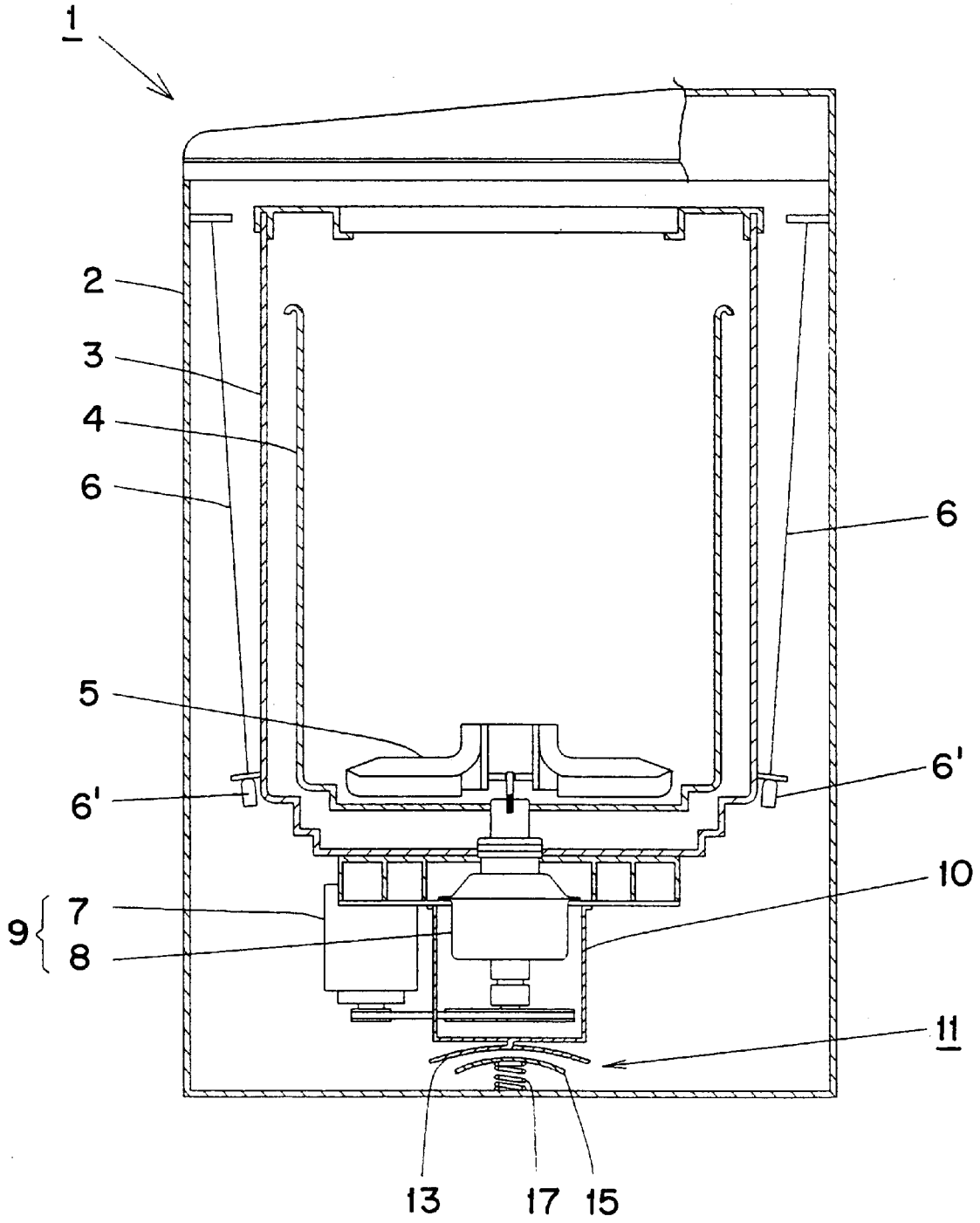
FIG. 2 is a transverse sectional view of FIG. 1.
Figure 24:
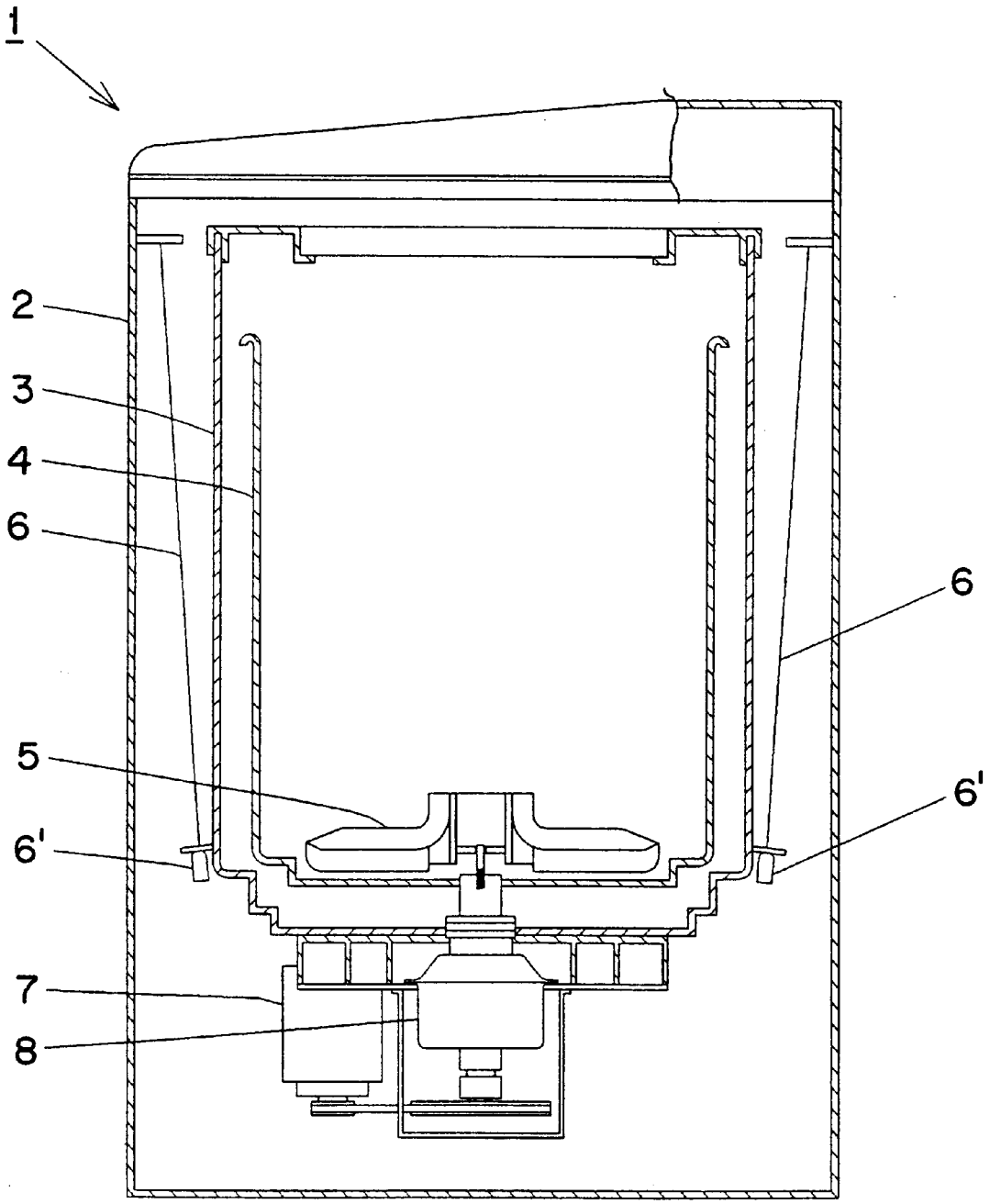
FIG. 24 (PRIOR ART)
FIG. 24 is a transverse sectional view of a conventional washing machine.

Referring to FIGS. 1 and 2, a washing machine 1 having a damper 11 includes an external casing 2 forming an external appearance, a tub 3 and a spin basket 4 which are accommodated in the external casing as in the conventional washing machine of FIG. 24. For easy explanation, the same labels and reference numerals are used for the same elements as in FIG. 24.

The external casing 2 has a generally rectangular vessel shape, and the tub 3 containing the water for washing and the spin basket 4 accommodating the laundry have a cylindrical shape. A plurality of throughholes for sharing the washing water with the tub 3 are formed in the wall surface of the spin basket 4. A pulsator 5 forming a rotational water current flow for washing is provided on the bottom of the spin basket 4. Also, the tub 3 is suspension-supported in the external casing by a suspension support 6, and the spin basket 4 is rotatably provided in the tub 3.

A power transmission unit 9 including a driving motor 7 and a shaft assembly 8 is installed in the lower side of the washing machine. The shaft assembly 8 is surrounded by a saddle 10 and is fixed on the bottom of the tub 3. The power transmission unit 9 rotates the spin basket 4 or the pulsator 5 in the forward or rearward direction according to an automatic program of a controller (not shown) to perform a washing cycle of the laundry washes.

Meanwhile, a damper 11 is installed between the lower side of the saddle 10 and the bottom of the external casing, 2. The damper 11 includes a first member 13 which is installed on the lower surface of the saddle 10, a second member 15 which is disposed opposed to the first member 13, and a spring member 17 for elastically supporting the second member 15 on the bottom of the external casing 2. The first member 13 and the second member 15 are formed of a plate-shaped body, respectively. The mutual contact surface of the first and second members 13 and 15 is a partial spherical surface. The spring member 17 formed of a compression coil spring urges the second member 15 upwards with respect to the tub 3 along the axial direction of the tub 3, to thereby elastically support the first member 13.

The first and second members 13 and 15 which may contact one another are made of a material which can maintain a mutual endurable frictional resistance, respectively. Such a material can be any one selected from a group consisting of rubber, polyamid, polyacetyl and polypropylene. In this embodiment, the first and second members 13 and 15 are formed of a steel plate having an excellent endurance, respectively. One of the above materials is interposed as a frictional material between the frictional contact surfaces, to enhance a frictional contact force.

By the above construction, if laundry is inserted into spin basket 4 of the washing machine 1, and washing water flows thereinto according to an automatic program stored in the controller according to a user's selection, the weight of the tub 3 gradually increases. In this case, when the amount of the laundry and the washing water accommodated in the tub 3 does not exceed a predetermined reference value, the vibration transferred to the tub 3 according to the rotation of the spin basket 4 during the washing, rinsing and dehydration operation of the washing machine becomes reduced by the suspension support 6.

Meanwhile, if the gradually increasing weight of the tub 3 exceeds the predetermined value, the first member 13 installed on the lower side of the tub 3 mutually contacts the second member 15 according to the load of the tub 3. As the weight of the tub 3 increases more, the spring member 17 is gradually compressed and the second member 15 urges the tub 3 upwards at the same time. Here, if the washing cycle of the washing machine proceeds, the vibration transferred to the tub 3 is primarily attenuated by the suspension support 6. Also, energy of the irregular and non-linear vibration, particularly the vibration due to left-and-right wobble is gradually lost by the mutual frictional contact of the first and second members 13 and 15, to accordingly suppress vibration by attenuation of vibration amplitude.

Also, during the dehydration operation, the up-and-down and left-and-right wobble of the tub 3 generated by disproportion of the laundry in the spin basket 4 is primarily attenuated by the suspension support 6 as described above, and effectively attenuated by a frictional contact by the damper 11. As a result, noise and wear of the washing machine induced by the vibration of the tub 3 is remarkably lowered.

Meanwhile, the damper applied to the washing machine according to the present invention can be formed of various shapes. Hereinafter, modifications or variations of the above-described embodiment will be described. Here, the same reference numerals and labels are assigned with respect to the same elements as those of the first embodiment in FIGS. 1 and 2.

Figure 3:
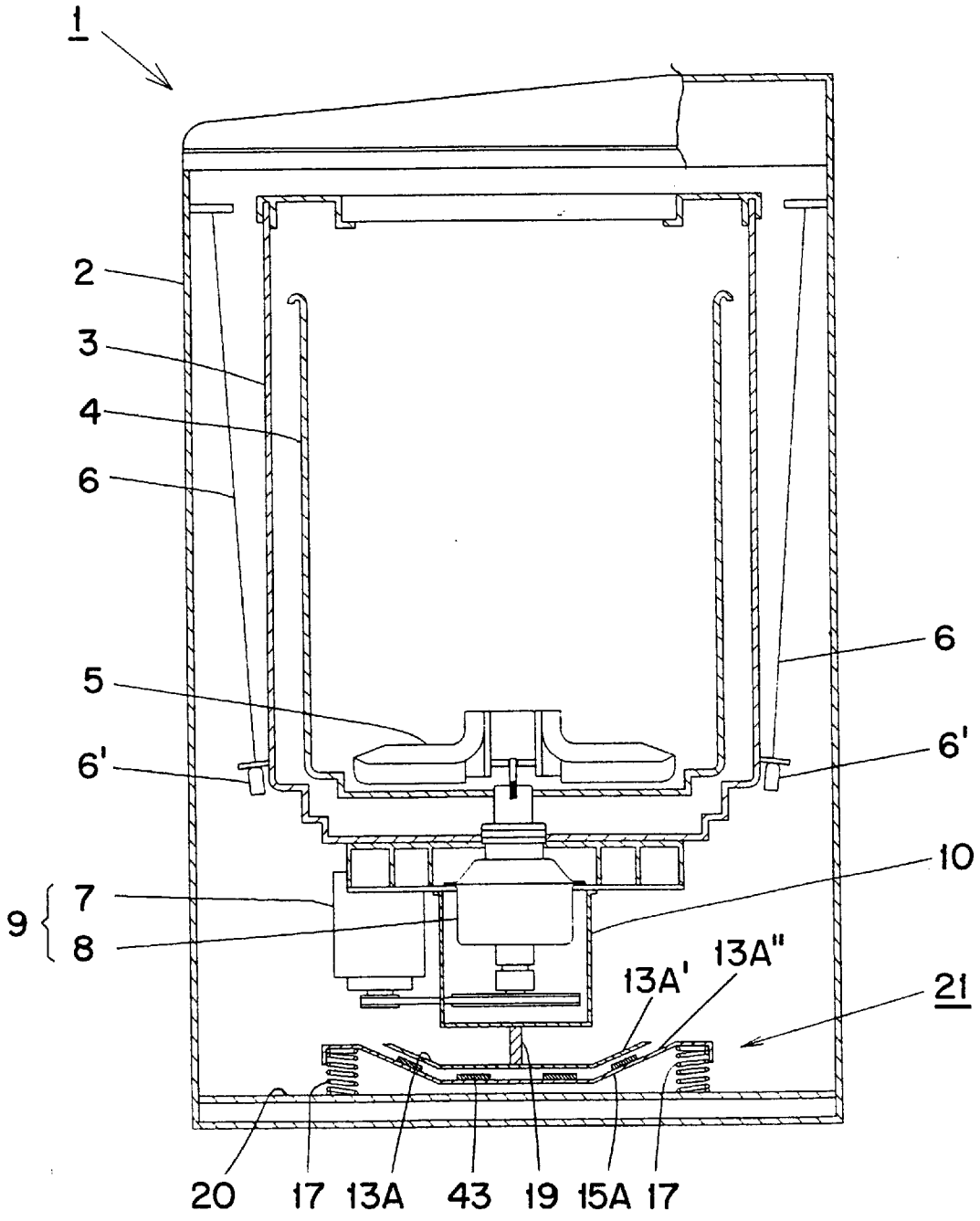
FIGS. 3 through 5 are transverse sectional views of a washing machine having a damper according to second through fourth embodiments of the present invention, respectively.

Referring to FIG. 3, a damper 21 according to a second embodiment includes a first member 13A which is installed on the lower side of the tub 3, a second member 15A which is disposed opposed to the first member 13A, and spring members 17 for elastically urging the second member 15A upwards with respect to the tub 3 along the axial direction of the tub 3. The first member 13A is installed on the free end of a connecting bar 19 which extends downwards from the bottom of the saddle 10, and the second member 15A is installed on a support plate 20 which is disposed in parallel with the upper side of the bottom of the external casing 2.

Also, the spring members 17, that is, compression coil springs are installed between the support plate 20 and the second member 15A. The first and second members 13A and 15A are of plate shape, and the contact surfaces have upwardly bent side pieces 13A', 13A". A plurality of frictional pieces 43 for maintaining a proper interval are interposed between the first and second members 13A and 15A. These frictional pieces 43 can be formed of a semi-sphere or a plate-shaped body. The frictional piece 43 plays a role of enabling the first member 13A to move with respect to the second member 15A in correspondence to the vibration of the tub 3.

In the damper 21 having the above-described structure, if the tub 3 vibrates due to the irregular and non-linear up-and-down and left-and-right wobble during rotational movement of the spin basket 4, the corresponding contact surfaces of the first and second members 13A and 15A contact mutually. Therefore, the vibration of the tub 3 is attenuated by the contact frictional force of the both members 13A and 15A, to accordingly remove the problems due to the vibration. In this case, the mutual frictional contact forces of the first and second members 13A, 15A are increased by the frictional pieces 43 interposed between the members 13A and 15A, to thereby more effectively attenuate the vibration of the tub 3.

Figure 4:
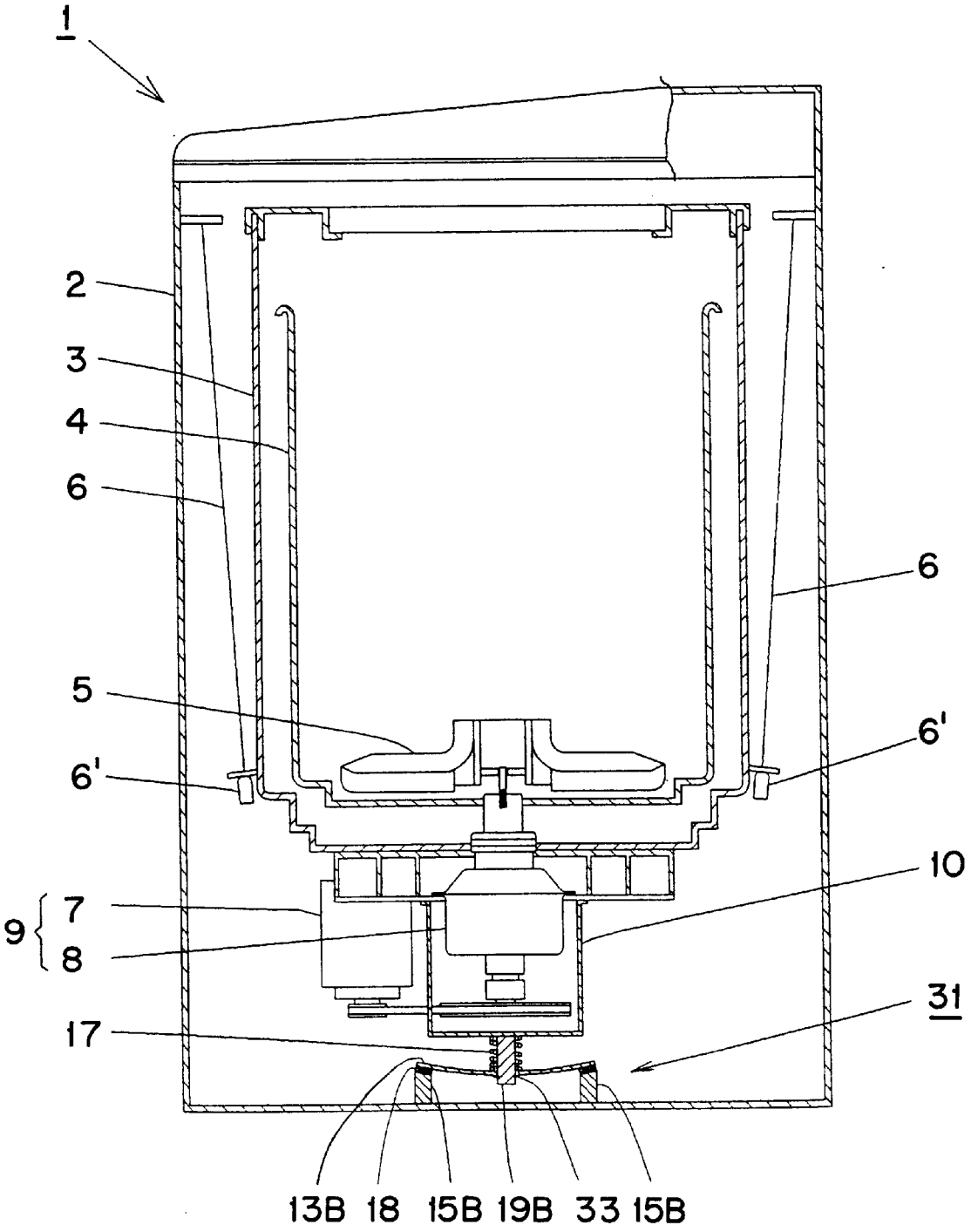

In a damper 31 according to a third embodiment shown in FIG. 4, a first member 13B is connected via a fixing ring 33 to the lower portion of a tub 3, that is, the distal end of a connecting bar 19B extending downwards from the lower surface of a saddle 10. The fixing ring 33 plays a role of limiting downward detachment of the first member 13B, in which case the first member 13B is installed movably up and down along the axial direction of the connecting bar 19B. Also, second members 15B are installed on the bottom of the external casing 2 to oppose the first member 13B. Also, a spring member 17 for elastically urging the first member 13B downwards is interposed between the first member 13B and the saddle 10. The spring member 17 is formed of a compression coil spring. A frictional material 18 is interposed between the first and second members 13B, 15B.

By the above construction, the damper 31 attenuates the vibration due to the irregular and non-linear up-and-down movement transferred to the tub 3 through the mutual frictional contact of the first and second members 13B, 15B. Here, the spring member 17 elastically urges the first member 13B, to its initial state, in which it contacts the second member 15B and is elastically urged downwards with respect to the tub 3 along the axial direction of the tub 3.

Figure 5:
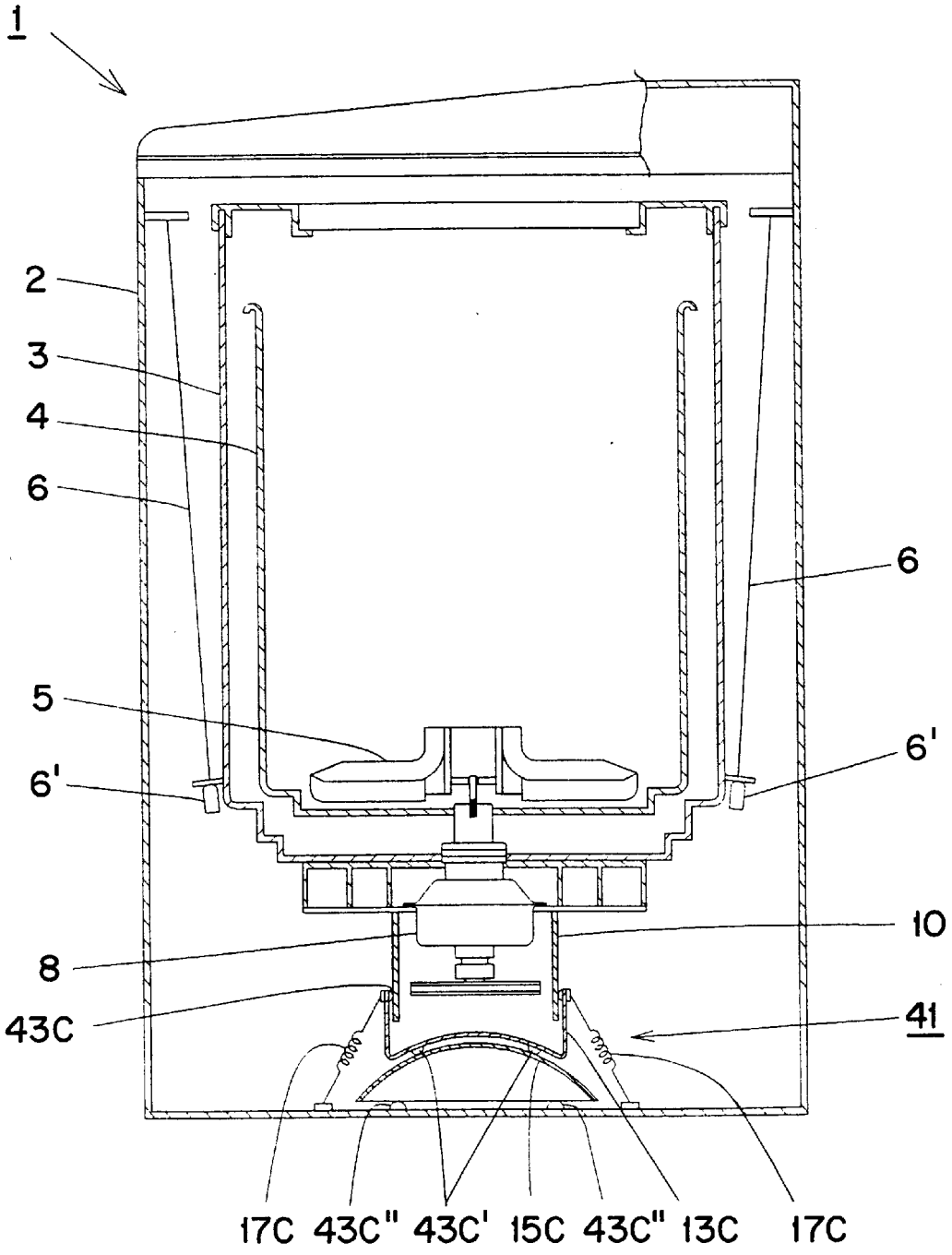

Referring to FIG. 5, a damper 41 includes a first member 13C which is connected to the lower portion of a tub 3, that is, the side surface of a saddle 10, a second member 15C which has a partial spherical body in correspondence to the first member 13C, and spring members 17C for elastically urging the first member 13C downwards with respect to the second member 15C to its initial state. Semi-sphere shaped frictional pieces 43C are interposed between the saddle 10 and the first member which has a concave surface corresponding to a convex surface of the second member 15C. The first member 13C can be moved in the up-and-down direction of the saddle 10.

Also, a plurality of semi-sphere shaped frictional pieces 43C' are interposed between the contact surfaces of the first and second members 13C, 15C, that is, the concave and convex surfaces thereof. Frictional pieces 43 are interposed between the second member 15C and the bottom of the external casing 2. Meanwhile, the spring members 17C comprise a pulling coil spring whose one end is fixed to the side edge of the first member 13C and other end is fixed to the bottom of the external casing 2.

Figure 6:
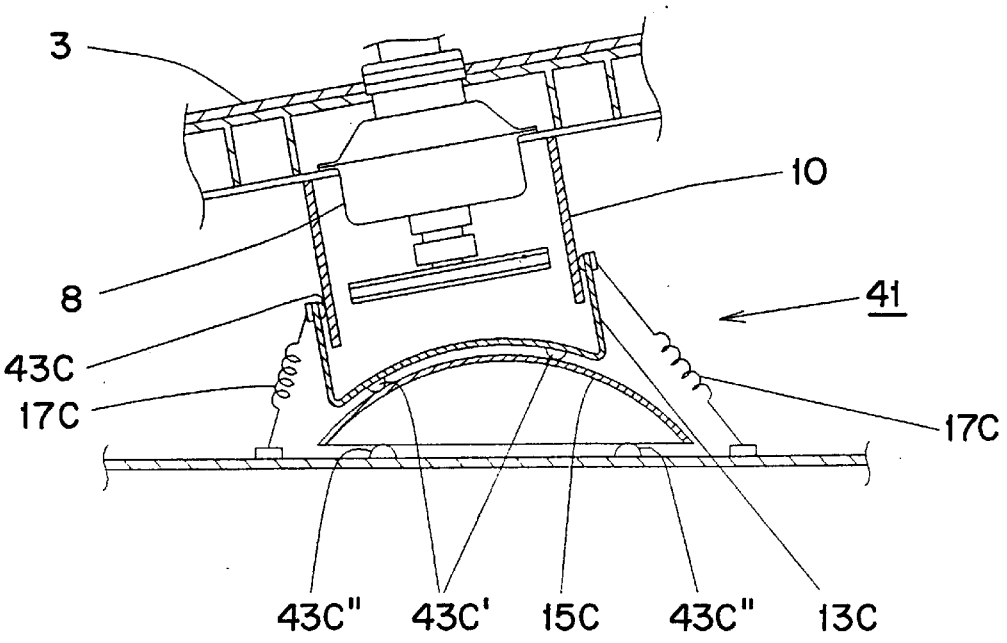
FIGS. 6 and 7 are enlarged sectional views showing respective operating states of the damper according to the fourth embodiment of FIG. 5, respectively.
Figure 7:
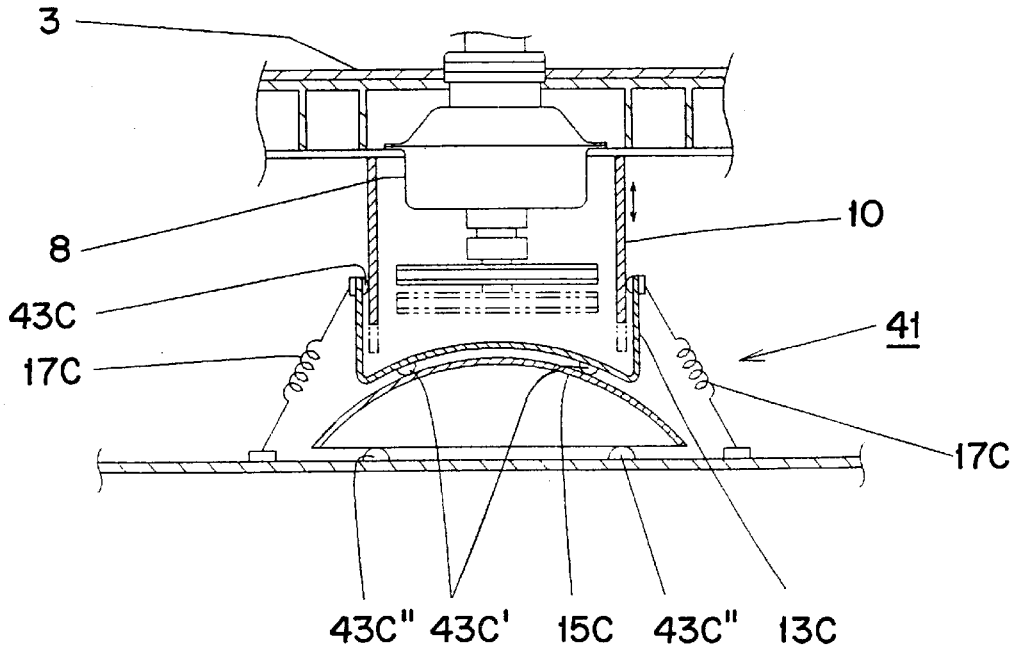

By the above construction, FIGS. 6 and 7 show operational states of the damper according to the fourth embodiment of FIG. 5. As can be seen from these drawings, if a tub 3 wobbles in the left-and-right direction according to rotation of a spin basket 4, the damper 41 suppresses the wobble via the frictional movement of a first and second members 13C, 15C and a restoring force of spring members 17C. That is, if the tub 3 is inclined in one direction, for example, to the left, the second member 15C contacting the first member 13C according to the pressing of the first member 13C moves right. As a result, the spring member 17C which is disposed in the left side of the first member 13C is pulled.

In this case, the contact surface of the second member 15C contacts the bottom of the external casing 2, and the contact surfaces of the first and second members 13C, 15C mutually contact. Thus, the vibrating energy transferred to the tub 3 becomes gradually extinct to attenuate the vibration.

Meanwhile, the tilted tub 3 is restored into the initial state by the restoring force of the spring members 17C. Here, the tub 3 can tilt to the other direction, for example, to the right. In this case, the vibration transferred to the tub 3 is attenuated according to a procedure reverse to the above. Also, as shown in FIG. 7, the up-and-down wobble generated at the same time with the left-and right wobble of the tub 3 is attenuated by the mutual frictional contact between the saddle 10 and the first member 13C and the restoring force of the spring members 17C.

Figure 8:
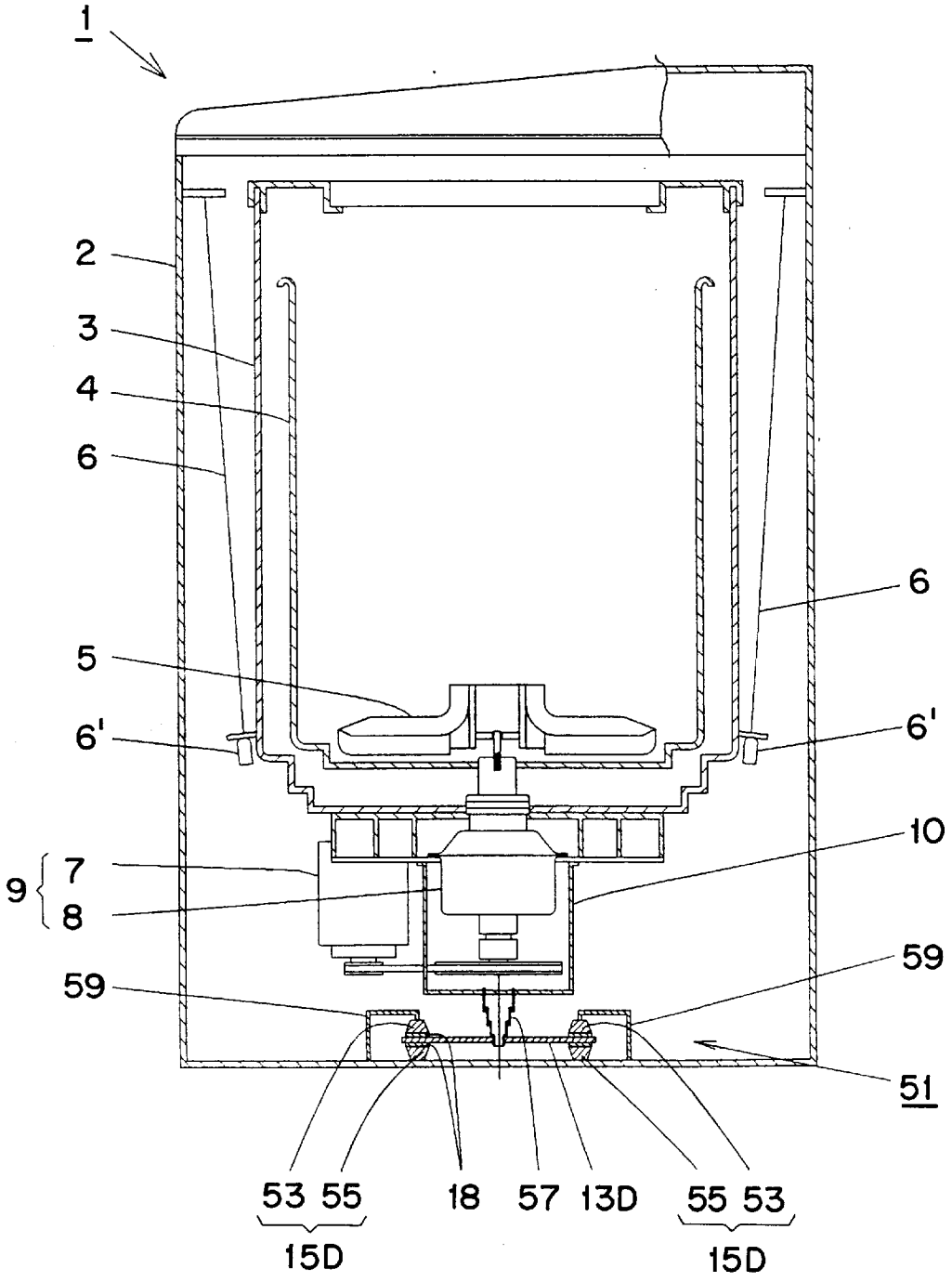
FIG. 8 is a transverse sectional view of a washing machine having, a damper according to a fifth embodiment of the present invention.
Figure 9:
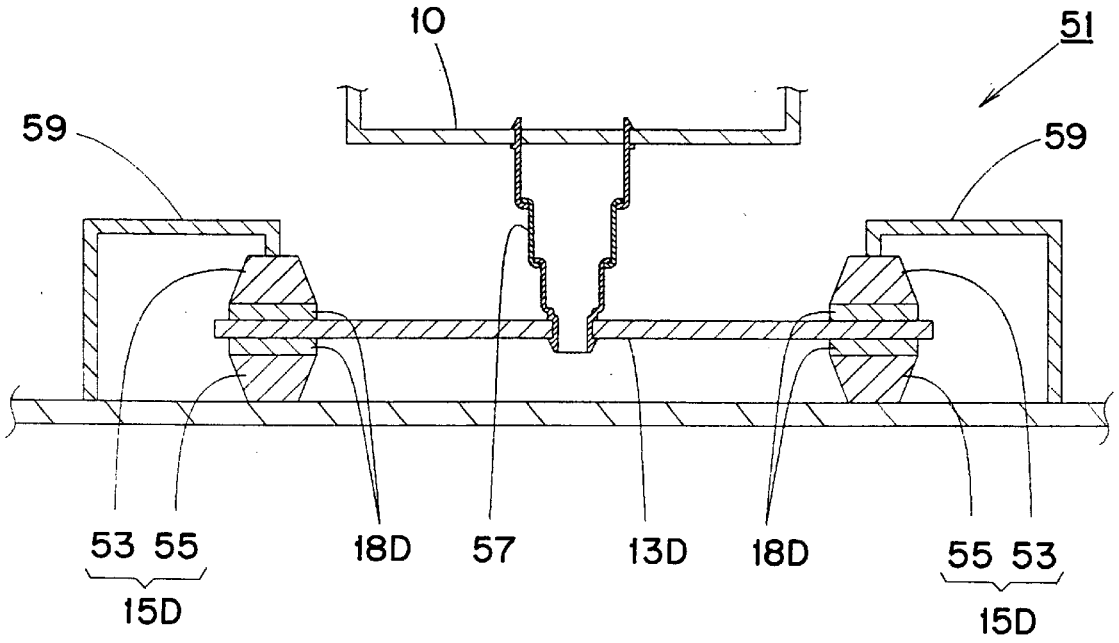
FIGS. 9 and 10 are enlarged sectional views showing respective operating states of the damper according to the fifth embodiment of FIG. 8, respectively.
Figure 10:
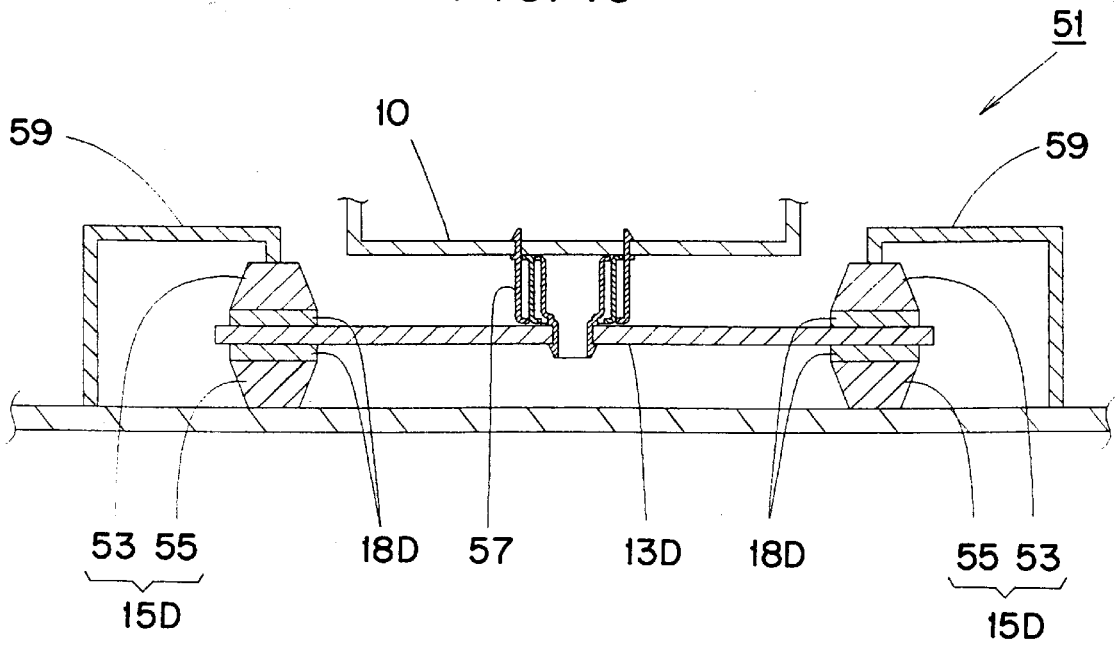

Meanwhile, FIG. 8 is a transverse sectional view of a washing machine having a damper according to a fifth embodiment of the present invention. FIGS. 9 and 10 are enlarged views showing an operating state of the damper according to the fifth embodiment of FIG. 8, respectively. As can be seen from these drawings, a damper 51 according to this embodiment includes a first member 13D receiving the vibration of a tub 3, and second members 15D which are installed opposing each other and each receiving an outer edge of the first member 13D. A throughhole is formed in the central area of the first member 13 and the distal end of a telescopic bar 57 which projects downward from the lower surface of the saddle 10 is fixed in the throughhole via a hook connection.

The second member 15D includes an upper frictional plate 53 which opposes the upper surface of the first member 13 and a lower frictional plate 55 which opposes the lower surface thereof. The second members 15D are fixed by supports 59 extending from the bottom of the external casing 2. Frictional materials 18D are interposed between the first member 13D and the upper and lower frictional plates 53 and 55.

By the above construction, if the tub 3 wobbles due to the rotation of the spin basket 4, the left-and-right wobble is attenuated by the mutual frictional contact between the first and second members 13D, 15D, that is, the upper and lower frictional plates 53 and 55. The up-and-down wobble is also attenuated by the lengthwise extension and contraction of the telescopic bar 57, and the mutual frictional contact of the first and second members 13D, 15D as shown in FIGS. 9 and 10.

Figure 11:
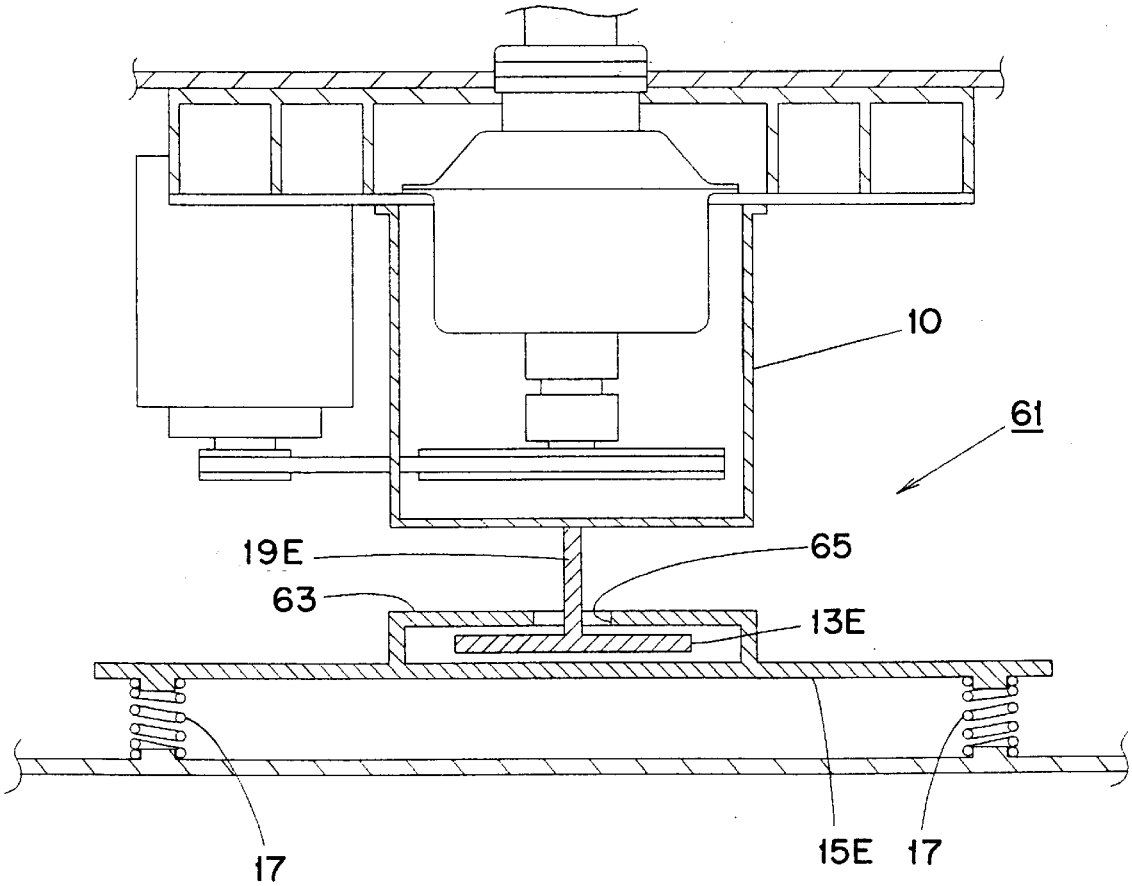
FIGS. 11 and 12 are a transverse sectional view of a washing machine having a damper according to sixth and seventh embodiments of the present invention, respectively.
Figure 12:
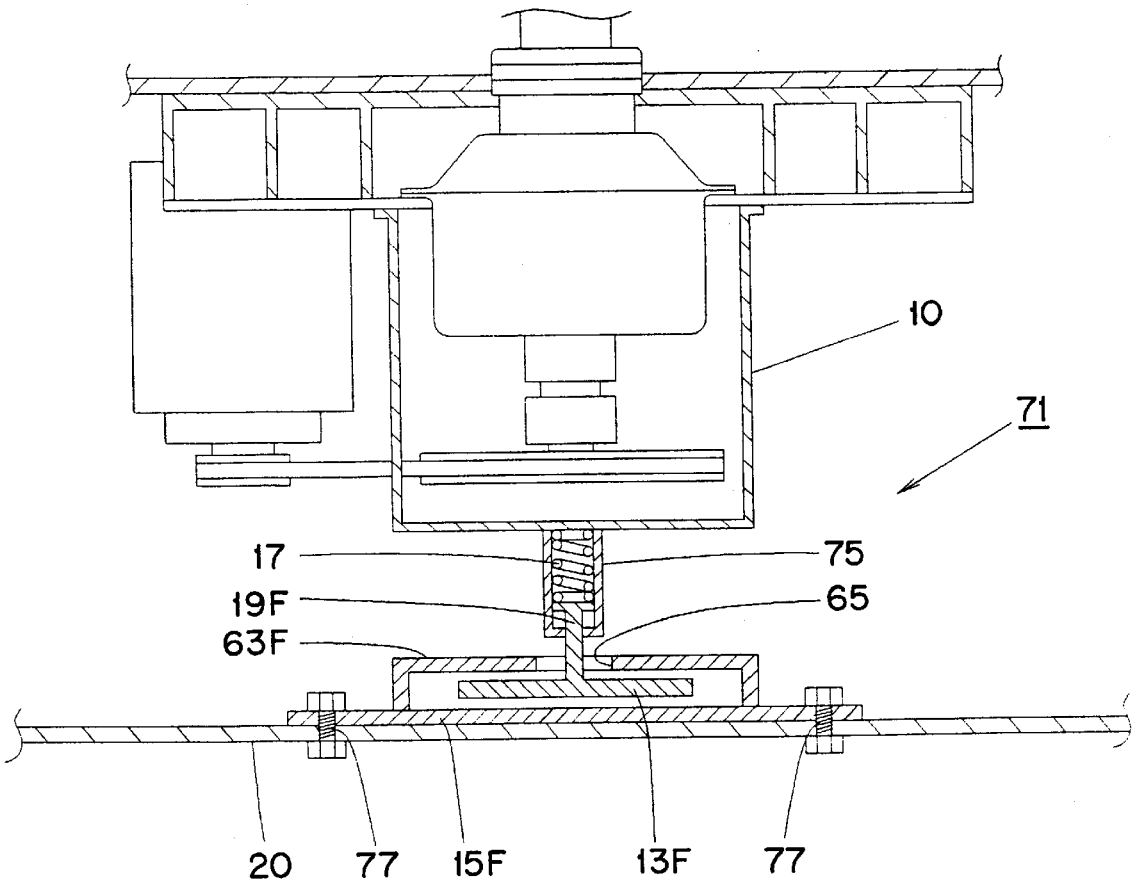

FIGS. 11 and 12 are enlarged transverse sectional views of washing machines having dampers according to sixth and seventh embodiments of the present invention, respectively. A damper 61 of a washing machine according to a sixth embodiment shown in FIG. 11, has a first member 13E installed on the lower portion of the tub 3, that is, the distal end of a connecting bar 19E extending downwards from the lower surface of a saddle 10. A second member 15E is installed on the bottom of an external casing 2. A fixing damper 63 accommodating the first member 13E for movement left and right is installed on the upper surface of the second member 15E.

A throughhole 65 for enabling the connecting bar 19E to be accommodated with clearance for movement left and right is formed in the central area of the fixing damper 63. The wobble of the connecting bar 19E to which the vibration of the tub 3 is transferred is limited by the throughhole 65. The upper and lower surfaces of the first member 13E frictionally contact the lower surface of the fixing damper 63 and the upper surface of the second member 15E, respectively. Meanwhile, spring members 17 are interposed between the second member 15E and the bottom of the external casing 2, to variably and elastically support the relative position of the second member 15E due to the up-and-down vibration of the tub 3.

By the above construction, the left-and-right vibration of the tub 3 according to rotation of the spin basket 4 is attenuated by a frictional resistance due to a frictional contact between the first member 13E and the second member 15E and between the first member 13E and the fixing damper 63, respectively. The up-and-down vibration of the tub 3 is attenuated by the second member 15E which is variably and elastically supported via the spring members 17. Thus, noise which is generated during a washing cycle, particularly, more seriously during a dehydrating cycle is suppressed.

A damper 71 according to a seventh embodiment shown in FIG. 12 has a support plate 20 which is fixed on the upper side of the bottom of an external casing (not shown). A second member 15F is fixed via bolt and nut connection 77 on the support plate 20. A fixing damper 63F having a throughhole 65 formed in the central area thereof is provided on the upper surface of the second member 15F. A first member 13F is accommodated in the fixing damper 63 so that it can be moved left and right. A connecting bar 19F extending upwards from the central area of the upper surface of the first member 13F is exposed outwards via the throughhole 65 of the fixing damper 63F. A damping tube 75 is connected to the saddle 10 from which it projects downwards. The connecting bar 19F is accommodated in the damping tube 75 so that it can be moved up and down. A spring member 17 is interposed between the connecting bar 19F and the bottom of the saddle 10.

The spring member 17 elastically urges the first member 13F downwards with respect to the tub 3 alone, the axial direction of the tub 3. The up-and-down wobble of the tub 3 is attenuated by the spring member 17. Also, the left-and-right wobble of the tub 3 is attenuated by the mutual frictional contact between the first member 13F, and the second member 15F and between the first member 13F and the fixing damper 63.

Figure 13:
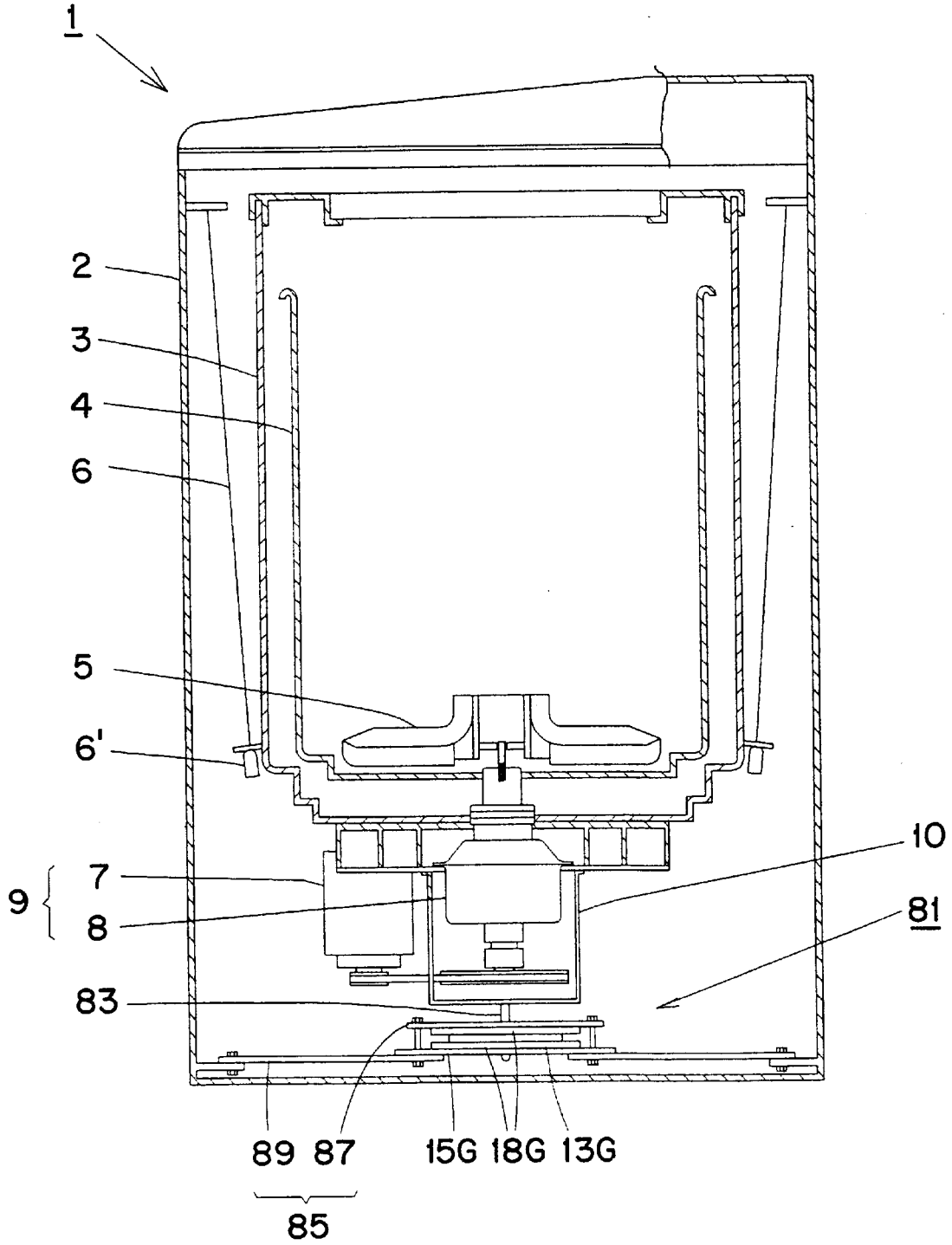
FIG. 13 is a transverse sectional view of a washing, machine having a damper according to an eighth embodiment of the present invention.
Figure 14:
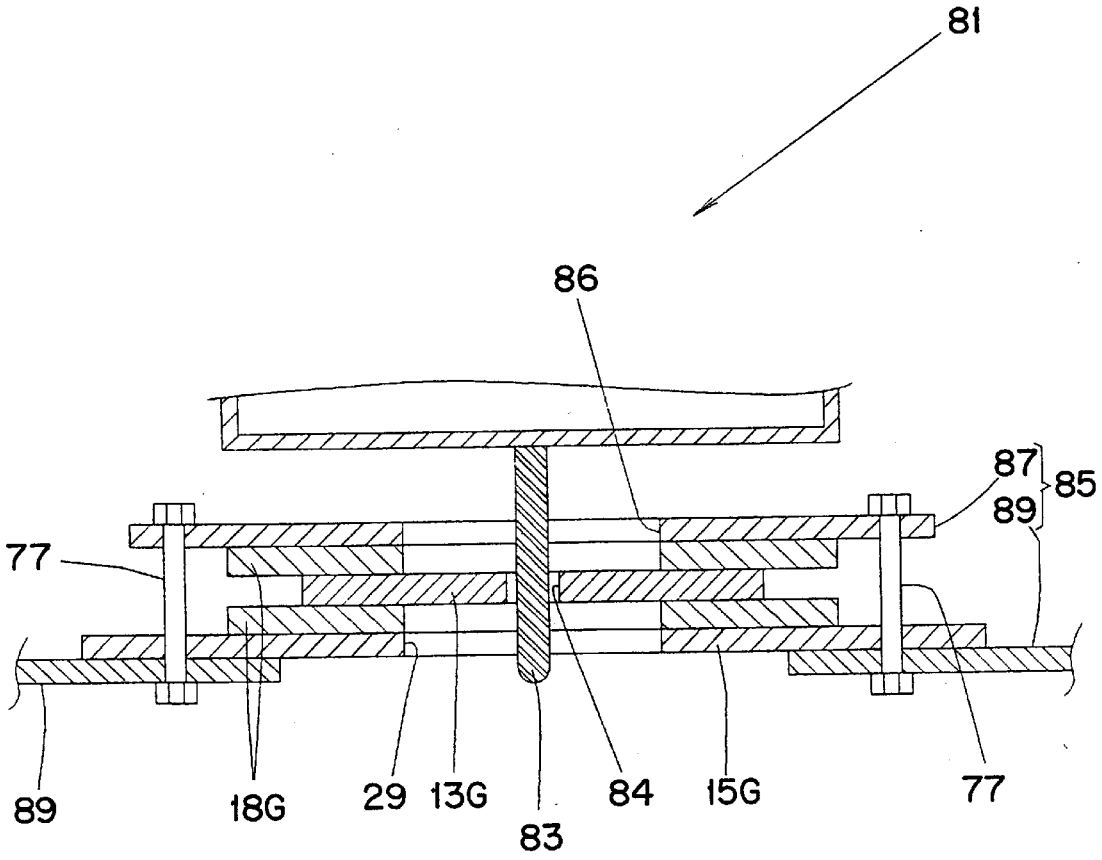
FIG. 14 is an enlarged sectional view showing, an operating, state of the damper according to the eighth embodiment of FIG. 13.

FIG. 13 is a transverse sectional view of a washing machine having a damper according to an eighth embodiment of the present invention. FIG. 14 is an enlarged view showing particularly the damper according to the eighth embodiment of FIG. 13. As can be seen from these drawings, a damper 81 has an acting bar 83 which extends downwards from the lower portion of the tub 3, that is, the central area of the lower surface of the saddle 10. A first member 13G having a damping hole 84 of a larger diameter than that of the section of the acting bar 83 is combined thereto so as to mutually frictionally contact a second member 15G and a third member 85. The third member 85 includes a damping upper plate 87 and a damping lower plate 89 which are respectively installed on the upper portions of the first member 13G and the lower portion of the second member 15G. The damping upper and lower plates 87 and 89 are mutually connected via bolt and nut connection 77. The second and third members 15G and 85 have a damping hole 86 having a larger diameter than that of the damping hole 84 formed on the first member 13G, respectively.

Meanwhile, both edges of the damping lower plate 89 extend laterally and are fixed on the left and right inner wall surfaces of the external casing 2. Accordingly, the frictional members 13G, 15G and 85 which are mutually connected are disposed at a predetermined interval from the bottom of the external casing 2. The acting bar 83 disposed downwards from the saddle 10 vertically penetrates the throughholes 84 and 86 of the frictional members 13G, 15G and 85. Thus, if the acting bar 83 receiving the up-and-down and left-and-right vibration of the tub 3 wobbles, the first member 13G wobbles left and right. In this case, since the first member 13G mutually frictionally contacts the lower surface of the damping upper plate 87 and the upper surface of the second member 15G, the vibration of the tub 3 is attenuated. Also, to more effectively attenuate the vibration of the tub 3, a frictional material 18G can be interposed between the first member 13G and each contact surface.

Figure 15:
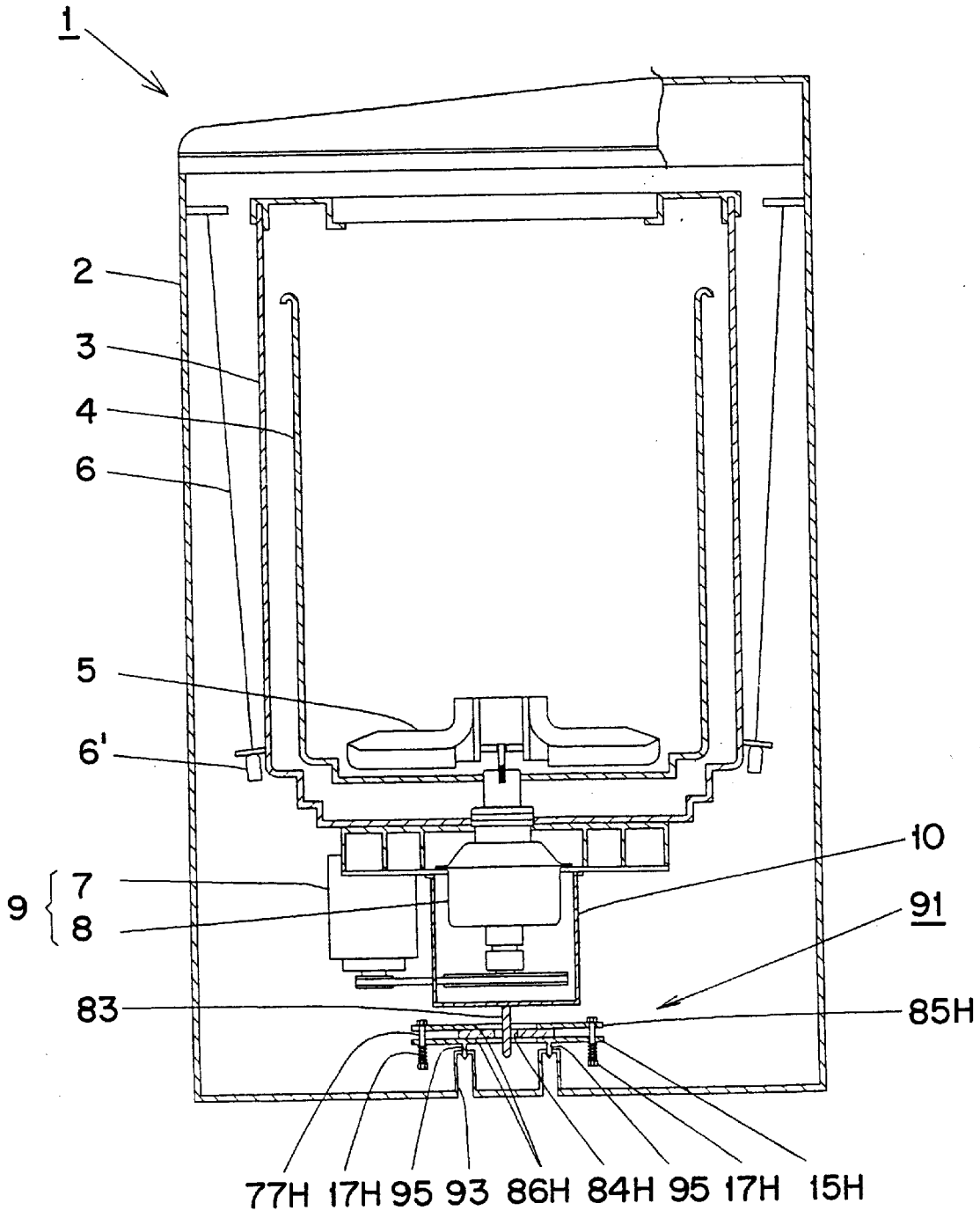
FIG. 15 is a transverse sectional view of a washing machine having a damper according to a ninth embodiment of the present invention.
Figure 16:
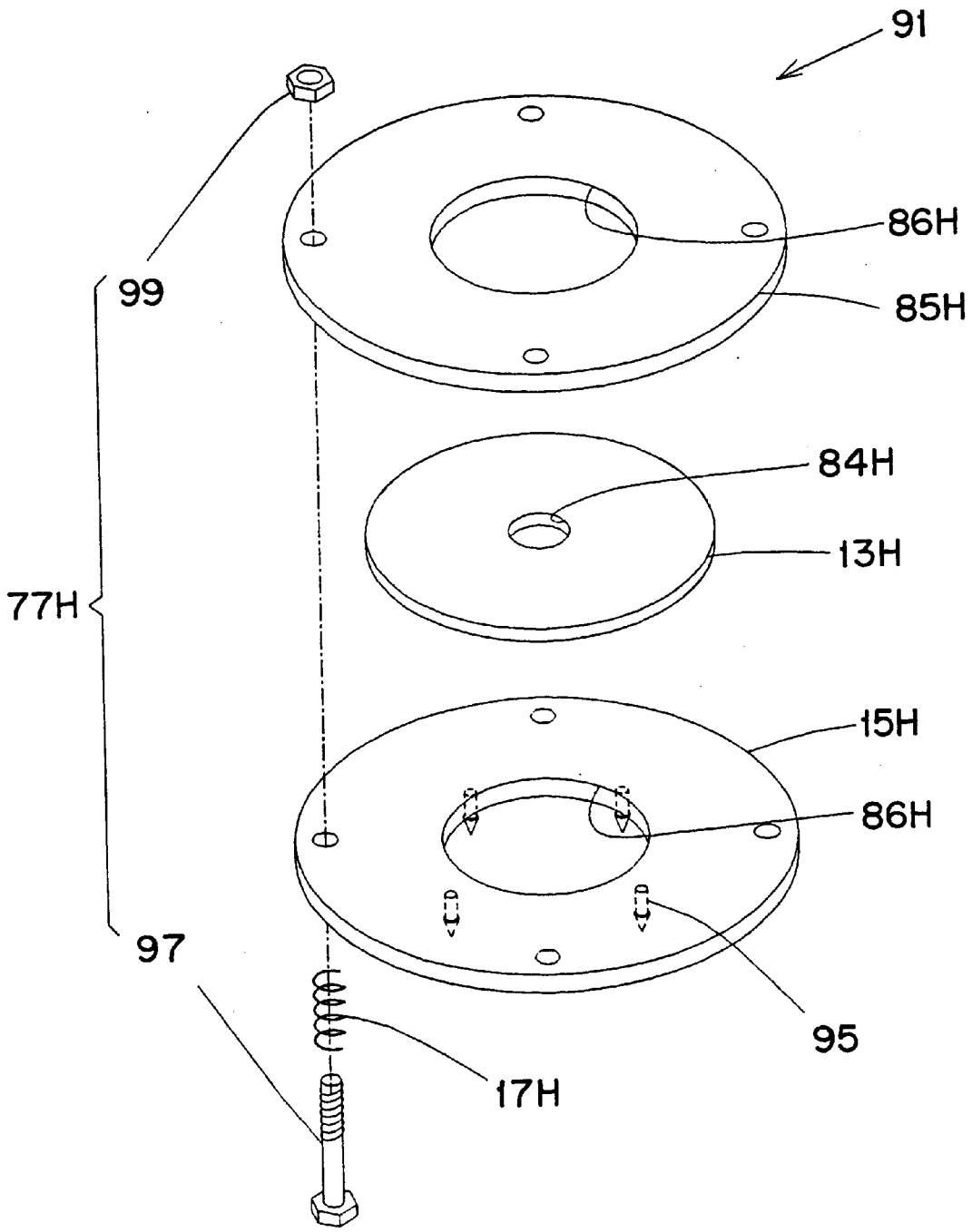
FIG. 16 is an enlarged exploded perspective view of the damper according to the ninth embodiment of FIG. 15.

Meanwhile, FIG. 15 is a transverse sectional view of a washing machine having a damper according to a ninth embodiment of the present invention. FIG. 16 is an enlarged exploded perspective view of the damper according to the ninth embodiment of FIG. 15. As can be seen from these drawings, a damper 91 has a first member 13H having an acting bar 83 which extends downwards from the lower portion of a tub 3, that is, the central area of the lower surface of a saddle 10 and a damping hole 84H having a larger diameter than that of the section of the acting bar 83, and a second member 15H and a third member 85H which are combined with each other up and down opposingly interposing the first member 13H. The second and third members 15H, 85H have a damping hole 86H with a larger diameter than that of the damping hole 84H formed on the first member 13H, respectively. The second and third members 15H, 85H are loosely connected with each other by a bolt 97 and a nut 99 at both edges thereof.

Also, a spring member 17H is interposed between the second member 15H and the bolt 77H. The spring member 17H elastically urges the second member 15H toward the first member 13H, and maintains a consistent connecting force of the frictional members 13H, 15H, 85H which are somewhat loosely connected by the bolt 77H. Meanwhile, a hollow rib 93 protrudes upwards on the bottom of the external casing 2. A hook accommodation hole (not shown) is formed on the upper portion of the rib 93. A hook 95 is formed on the corresponding lower surface of the second member 15H. The mutually combined frictional members 13H, 15H, 85H can be disposed at a predetermined interval on the upper side of the bottom of the external casing 2 by the hook 95 and the hook accommodation hole. The acting bar 83 disposed downwards from the saddle 10 vertically penetrates into the damping holes 84H, 86H of the such disposed frictional members 13H, 15H, 85H.

By the above construction, if the tub 3 vibrates in the up-and-down and left-and-right direction according to rotation of the spin basket 4, the damper 91 wobbles in the damping, hole since the vibration is transferred to the acting bar 83. In this case, the first member 13H wobbles left and right direction by the acting bar 83 and mutually frictionally contacts the second and third members 15H, 85H. Accordingly, the vibration of the tub 3 is attenuated to suppress noise generation. To enhance an attenuation effect, a frictional material can be interposed between the mutual contact surfaces of members 13H, 15H, 85H.

Figure 17:
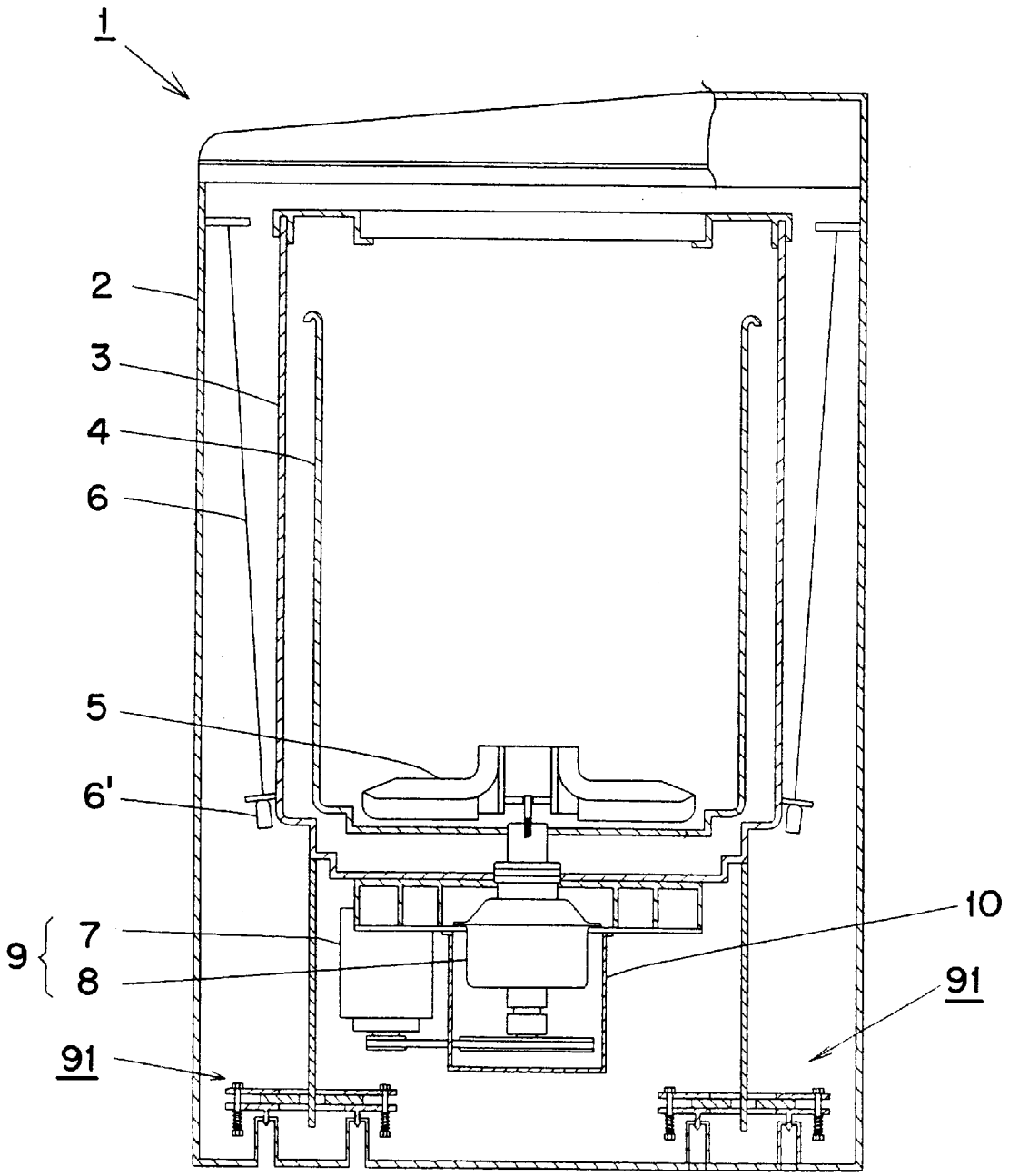
FIGS. 17 and 18 are a transverse sectional view of a washing machine having a damper according to tenth and eleventh embodiments of the present invention, respectively.
Figure 18:
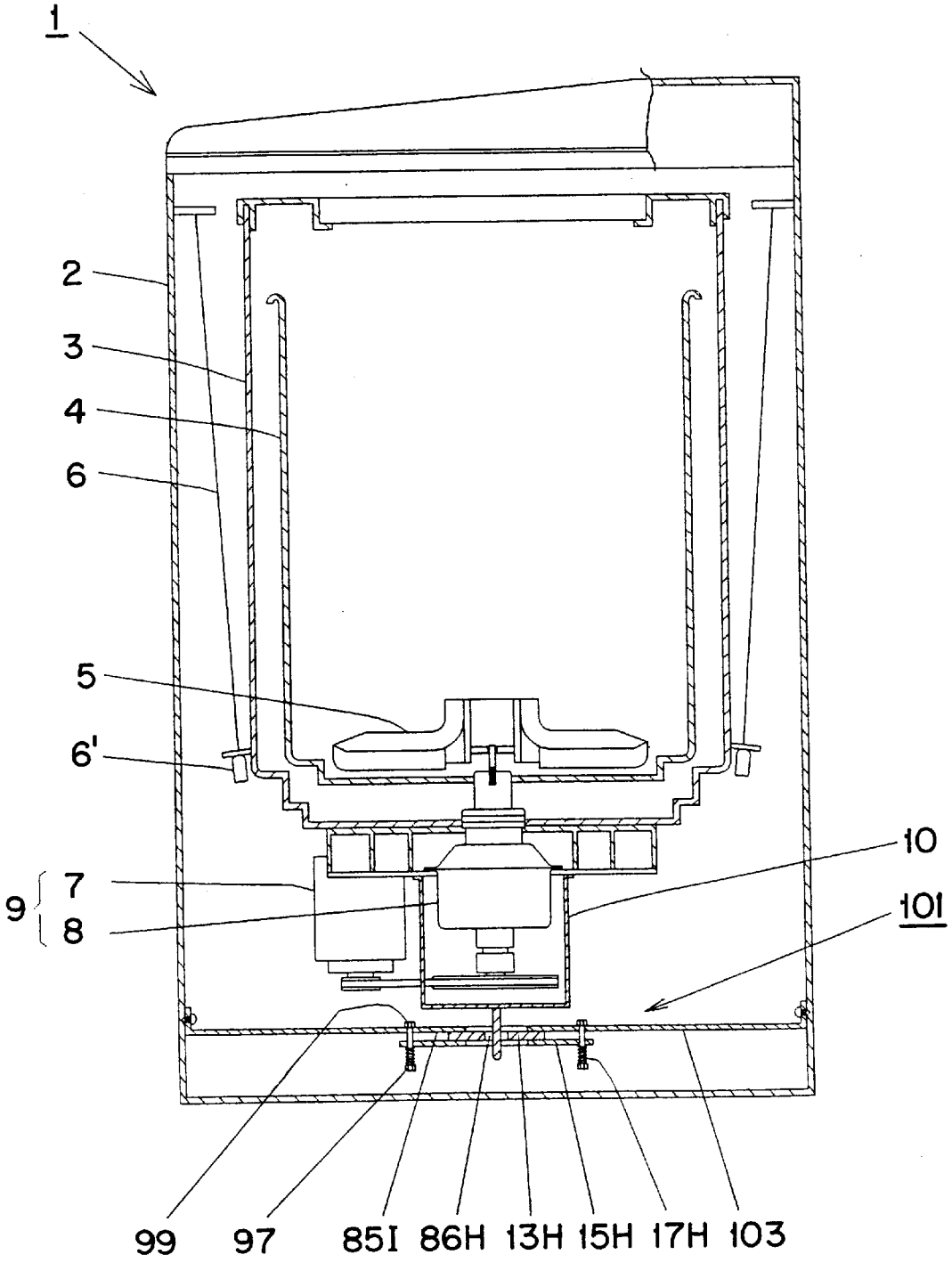
Figure 19:
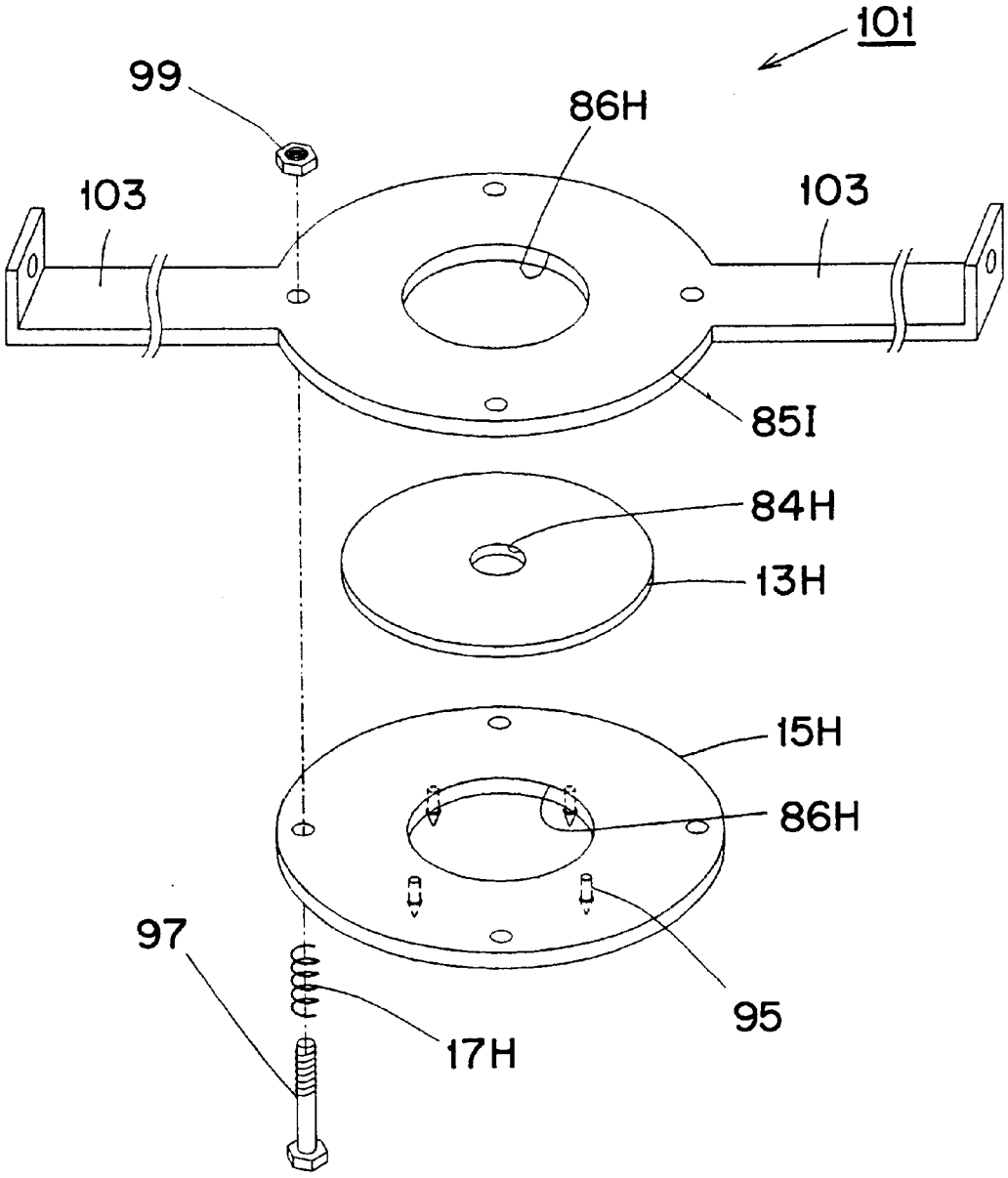
FIG. 19 is an enlarged exploded perspective view of the damper according to the eleventh embodiment of FIG. 18.

FIGS. 17 and 18 are a transverse sectional view of a washing machine having a damper according to tenth and eleventh embodiments of the present invention, respectively. In these drawings, dampers having the same structure as that of ninth embodiment of FIGS. 15 and 16 are installed. In the washing machine 1 shown in FIG. 17, a plurality of dampers 91 are symmetrically installed around a longitudinal axis line of the tub 3. In a washing machine 1 shown in FIG. 18 and 19, a support structure of a damper 101 according to the ninth embodiment is modified. In the damper 101, both edges 103 of a third member 85I extend laterally and are fixed on the side wall surface of the external casing 2. Accordingly, frictional members 13H, 15H, 85H are disposed at a predetermined interval on the bottom of the external casing 2.

The dampers 91 and 101 having the above-described structures provide the same vibration attenuation effect as in the previous embodiments.

Figure 20:
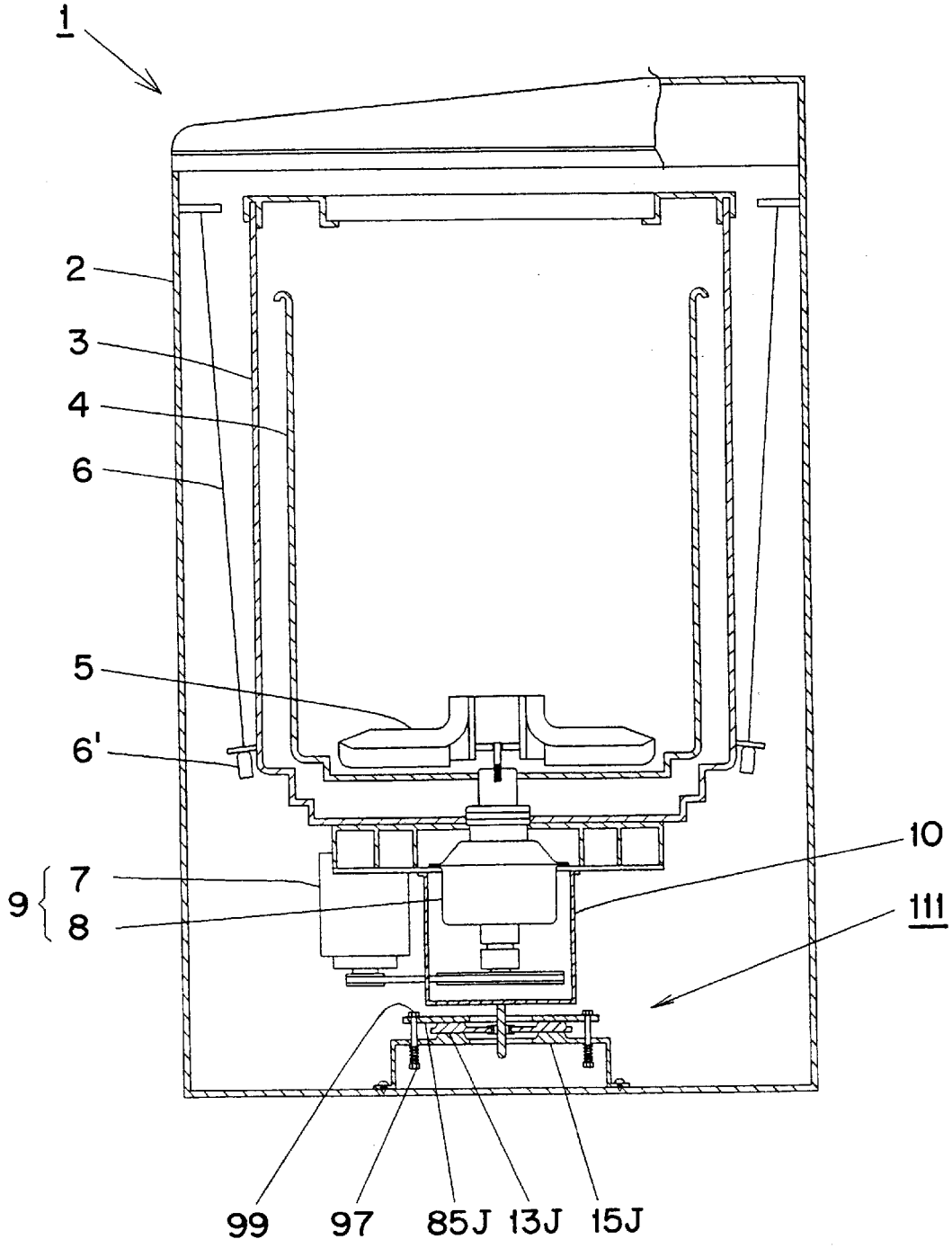
FIG. 20 is a transverse sectional view of a washing machine having a damper according to a twelfth embodiment of the present invention.
Figure 21:
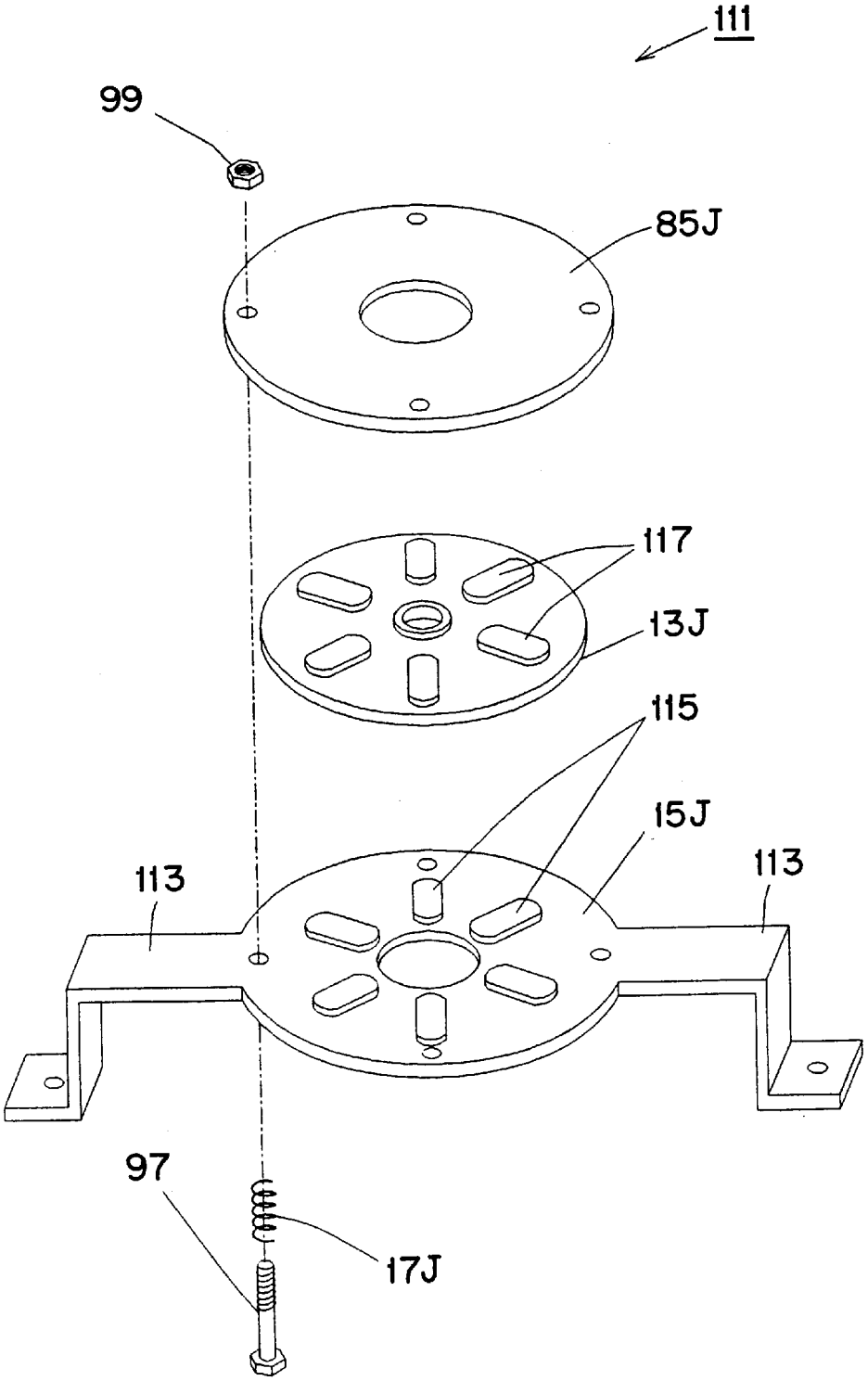
FIG. 21 is an enlarged exploded perspective view of the damper according to the twelfth embodiment of FIG. 20.

Meanwhile, FIG. 20 is a transverse sectional view of a washing machine having a damper according to a twelfth embodiment of the present invention. FIG. 21 is an enlarged perspective exploded view of the damper according to the twelfth embodiment of FIG. 20. A damper 111 according to this embodiment has a slightly improved structure different from those of FIGS. 15 through 19, in which a mounting structure is also modified. In other words, as can be seen from the drawings, a mounting rib 113 which extends from both edges of a second member 15J and is bent downwards is provided, through which the damper 111 is fixed to the bottom of an external casing 2.

Also, a plurality of frictional contacts 115 and 117 protruding from each plate surface are provided at a predetermined interval alone, the circumferential direction on the first and second members 13J, 15J. These frictional contacts 115 and 117 create a distance between the respective frictional members. Accordingly, a foreign substance such as water which migrates into the damper 111 flows out via the space, which enables a contact frictional force between the frictional members 13J, 15J, 85J constant.

Figure 22:
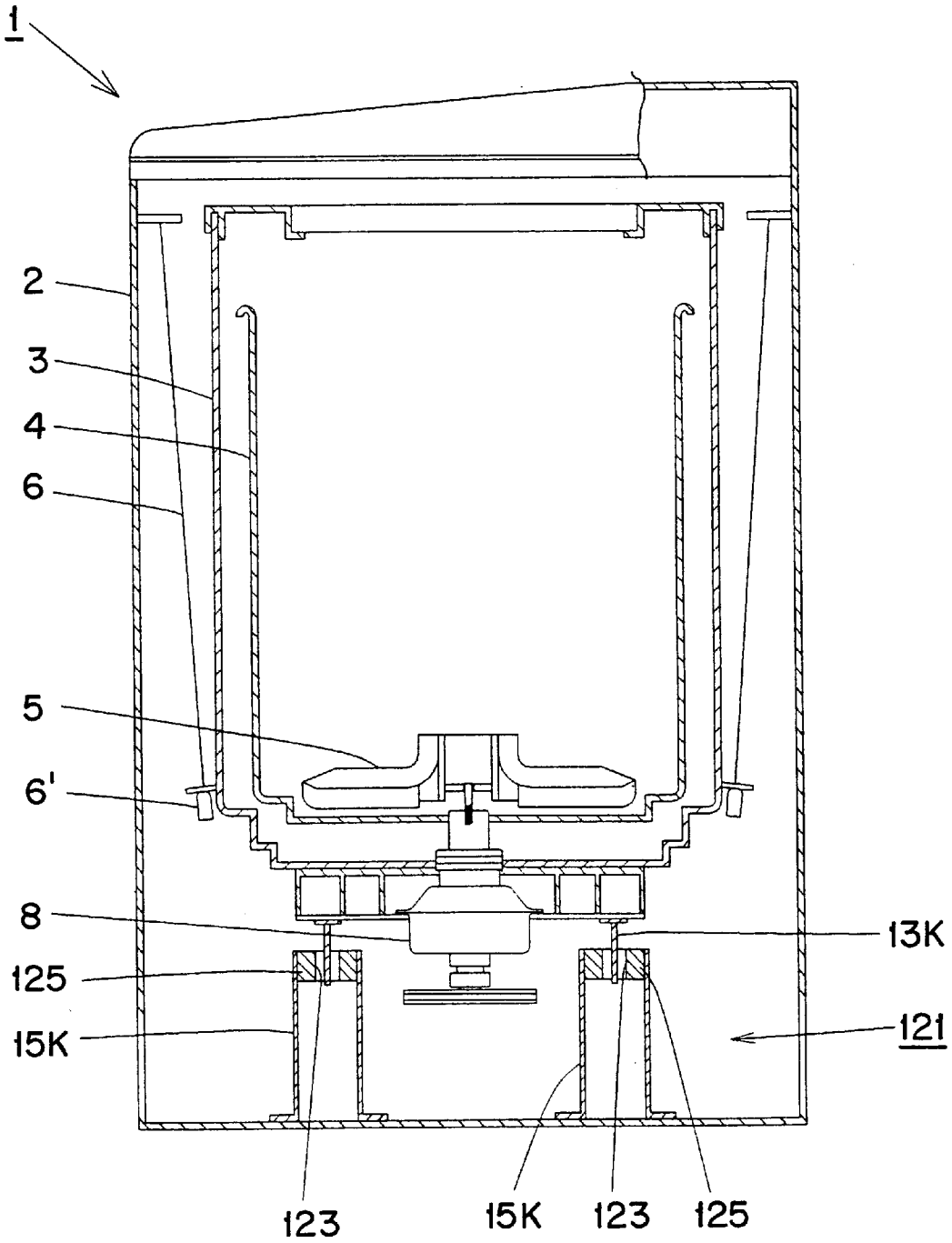
FIG. 22 is a transverse sectional view of a washing machine having, a damper according to a thirteenth embodiment of the present invention.

Meanwhile, FIG. 22 is a transverse sectional view of a washing machine having a damper according to a thirteenth embodiment of the present invention. The washing machine 1 shown in FIG. 22 has a slightly different construction from those of the previous embodiments. A damper 121 includes first members 13K which extend downwards from the lower portion of a tub 3 and second members 15K which are installed on the bottom of an external casing 2 and have an accommodation hole 123 for accommodating the end of the first members 13K with clearance. An elastic attenuation member 125 which is elastically deformed by contacting the first member 13 is attached in the inner surface of the accommodation hole 123 in each of the second members 15K. It is preferable that the elastic attenuation member 125 is formed of a vibration-proof material having a weak restoring force and a buffering capacity such as a sponge material.

By the above construction, if the tub 3 irregularly vibrates in the up-and-down and left-and-right directions by rotation of the spin basket 4, the first members 13K vibrate in the same direction as the tub 3. Here, the first members 13K are accommodated in the accommodation hole of the second member 15K and the wobble width thereof is limited. Thus, the wobble width of the tub 3 is limited as well, which provides an attenuation effect of the vibration of the tub 3.

At least one pair of dampers having the above construction can be provided on the bottom of the external casing 2, which doubles the above effect.

Figure 23:
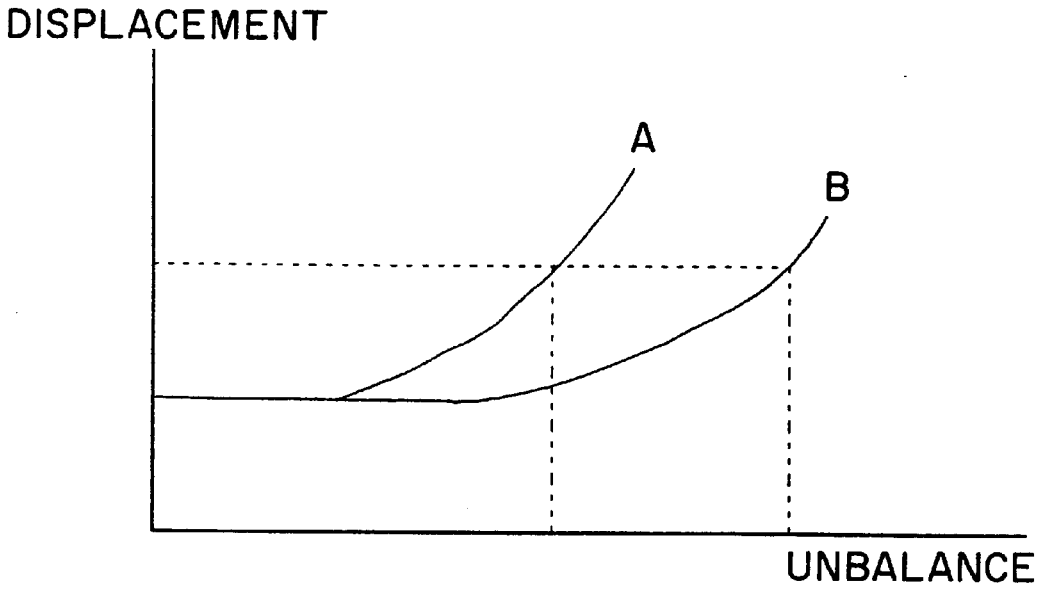
FIG. 23 is a characteristic graph showing an initial procedure of a dehydrating cycle wherein displacement of a spin basket is compared with an initial unbalance amount of the laundry using dampers according to the present invention and the prior art.

FIG. 23 is a characteristic graph showing an initial procedure of a dehydrating cycle with respect to an unbalance amount of the laundry by the damper according to the present invention and the prior art. The graph shows a comparison result of displacement that is, a vibration amount of the conventional tub 3 with that of the tub 3 in which a damper 11, 21, 31, 41, 51, 61, 71, 81, 91, 101, 111, or 121 according to the present invention is installed,. A characteristic curve "A" indicates a vibration amount of the conventional tub 3 with respect to the unbalance of the laundry, and the other characteristic curve "B" indicates a vibration amount of the tub 3 having a damper 11, 21, 31, 41, 51, 61, 71, 81, 91, 101, 111, or 121 according to the present invention, Here, the characteristic curve "B" shows an average experimental value of the vibration amount by the damper 11, 21, 31, 41, 51, 61, 71, 81, 91, 101, 111, or 121 according to the present invention.

As can be seen from these characteristic curves, the washing machine l having the damper 11, 21, 31, 41, 51, 61, 71, 81, 91, 101, 111, or 121 according to the present invention exceedingly reduces the vibration of the tub 3 generated by the rotation of the spin basket 4 during a washing cycle, particularly, an initial dehydrating cycle, compared with the conventional washing machine.

The washing machine 1 having a damper according to the present invention is not limited in the above-described embodiments, and can be embodied by various modifications within the scope of the appended claims.

As described above, the washing machine having a damper according to the present invention effectively attenuates vibration generated during washing, rinsing and dehydrating, cycles which is proportional to the amount of the laundry input into the spin basket. In order words, the linear vibration of the tub due to the presence of an amount of laundry less than a predetermined value is attenuated by a suspension support as in the conventional art. The vibration of the tub when an excessive amount of laundry is input is primarily attenuated by the conventional suspension support and is secondarily attenuated by a mutual frictional contact between the first and second members via the damper according to the above-described embodiments.

Therefore, the non-linear and irregular vibration of the tub generated in the up-and-down and left-and-right direction due to the rotation movement of the spin basket can be effectively attenuated. Accordingly, the noise due to the vibration can be reduced considerably, and a more stable washing operation can be performed.

What is claimed is:

1. A clothes washing machine comprising:

an external casing;

a tub suspended from the external casing, and a spin basket installed in the tub for rotation about an axis;

a first member installed at a bottom of the tub for wobbling movement therewith, and being movable with respect to the tub along the axis;

a second member for attenuating vibration transferred to the tub by frictional contact with the first member in response to wobbling of the tub;

wherein a throughhole is formed in a center area of the first member in alignment with the axis; and an action bar being fixed to the tub and extending downwardly through the throughhole of the first member for vertical movement relative thereto.

2. The washing machine according to claim 1, wherein a frictional material is interposed between the first and second members.

3. The washing machine according to claim 1, wherein the first and second members have planar frictional contact surfaces.

4. The washing machine according to claim 1, further including a spring member interposed between the first member and the tub for elastically urging the first member toward the second member.

5. The washing machine according to claim 1, wherein the second member is movable along the axis with respect to the bottom surface of the external casing.

6. The washing machine according to claim 5, further including a spring member interposed between the second member and the bottom surface of the external casing for elastically urging the second member toward the first member.

7. The washing machine according to claim 1, further comprising a third member arranged oppose the second member with the first member interposed between the second and third members for frictional contact therewith.

8. The washing machine according to claim 7, further comprising an elastically pressing means for elastically pressing the second and third members against the first member.

9. A clothes washing machine comprising:

an external casing;

a tub suspended from the external casing, and a spin basket installed in the tub for rotation about an axis;

a first member installed at a bottom of the tub for wobbling movement therewith, and being movable with respect to the tub along the axis; and a second member for attenuating vibration transferred to the tub by frictional contact with the first member in response to wobbling of the tub; and a telescopic bar having one end fixed to the tub and another end fixed to the first member, the telescopic bar being extendable and contractible along the axis.

10. The washing machine according to claim 9, wherein the first and second members have non-planar frictional contact surfaces.

11. The washing machine according to claim 9, further including a spring member installed between the first member and the bottom of the external casing for elastically urging the first member toward the second member.

12. A clothes washing machine comprising:

an external casing;

a tub suspended from the external casing, and a spin basket installed in the tub for rotation about an axis;

a first member installed at a bottom of the tub for wobbling movement therewith; and a second member for attenuating vibration transferred to the tub by a mutual action with the first member, wherein the first member comprises a bar extending axially downwardly from the tub, the second member having an accommodation hole for accommodating the first member with lateral clearance, and an elastic attenuation member which contacts the first member to be elastically deformed thereby is attached to an inner surface of the accommodation hole.

* * * * *